US006153841A

United States Patent [19]

Hart

[11] Patent Number: 6,153,841

[45] Date of Patent: Nov. 28, 2000

[54] CONTROL APPARATUS

[75] Inventor: Roy L. Hart, Laguna Niguel, Calif.

[73] Assignee: Eaton Corporation, Cleveland, Ohio

[21] Appl. No.: 09/422,012

[22] Filed: Oct. 21, 1999

[51] Int. Cl.[7] ..... H01H 9/00

[52] U.S. Cl. ..... 200/314

[58] Field of Search ..... 200/314, 329, 200/292, 459–461, 526, 523

[56] References Cited

U.S. PATENT DOCUMENTS

| | | | |
|---|---|---|---|
| 3,315,535 | 4/1967 | Stevens . | |
| 4,332,990 | 6/1982 | Stevens . | |
| 4,488,020 | 12/1984 | Zalewski et al. | 200/76 |
| 5,294,900 | 3/1994 | Mohabbatizadeh et al. . | |
| 5,296,826 | 3/1994 | Hart et al. . | |
| 5,659,162 | 8/1997 | Hart . | |
| 5,861,796 | 1/1999 | Benshoff . | |

*Primary Examiner*—Michael L. Gellner
*Assistant Examiner*—Nhung Nguyen
*Attorney, Agent, or Firm*—Tarolli, Sundheim, Covell, Tummino & Szabo L.L.P.

[57] ABSTRACT

An improved control apparatus includes an actuator module mounted on an upper side of the circuit board and a switch module mounted on the lower side of the circuit board. The actuator module includes a push button which is manually movable between an unactuated position and an actuated position. A force transmitting member extends from the push button, through the circuit board, into the switch module. An actuator link is movable relative to the housing to effect operation of a plurality of switches between an unactuated condition and an actuated condition in response to movement of the push button. A releasable connector is provided to connect both the actuator link and a switch action mechanism with the force transmitting member. The force transmitting member can be disconnected from the actuator link and the switch action mechanism by pulling the push button away from the circuit board. A closure on the housing can be opened to provide access to the switch action mechanism to enable the operating characteristics of the switches to be changed.

84 Claims, 11 Drawing Sheets

CONTROL APPARATUS

BACKGROUND OF THE INVENTION

The present invention relates to a new and improved control apparatus and more particularly to a control apparatus which includes one or more switches and may be connected with a circuit board.

Aircraft control panels have typically included switches and indicators. These switches and indicators have included light sources and may be connected with electrical circuitry disposed on a printed circuit board. Known switches which may be utilized in association with controls for aircraft are disclosed in U.S. Pat. Nos. 4,332,990; 5,294,900; 5,659,162; and 5,861,796. Although these known switches are advantageously utilized in association with aircraft control panels, they may be utilized to perform control functions in association with other types of apparatus, such as a machine which is used in a building during the manufacture of articles.

SUMMARY OF THE INVENTION

The present invention relates to a new and improved control apparatus which includes a manually engagable push button disposed adjacent to a first side of a circuit board. One or more switches may be enclosed by a housing disposed adjacent to a second side of the circuit board. A force transmitting member may extend from the push button through an opening in the circuit board into the housing. The force transmitting member is movable under the influence of force applied to the push button to effect operation of at least one switch in the housing.

A plurality of switches may be disposed in the housing in an array which extends around the force transmitting member. An actuator link may be connected with the force transmitting member and the plurality of switches. Upon actuation of the push button and movement of the force transmitting member, the actuator link is moved to effect operation of the switches between an unactuated condition and an actuated condition. The switches may have any desired construction.

A releasable connector connects the components in the housing with the push button. The releasable connector may be operated to a disengaged condition. The housing and components therein may then be disconnected from the circuit board and replaced by another housing containing the same or different components. The releasable connector may be operated from an engaged condition to a disengaged condition by moving the push button away from the circuit board.

The housing may be opened, while the housing is still connected with the circuit board, to enable operating characteristics of one or more switches enclosed by the housing to be changed. For example, the operating characteristics of a switch enclosed by the housing may be changed between an alternate action switch and a momentary action switch. This change is effected while terminals connected with the switch remain connected to the circuit board.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

Control Panel Assembly

Figure 1:
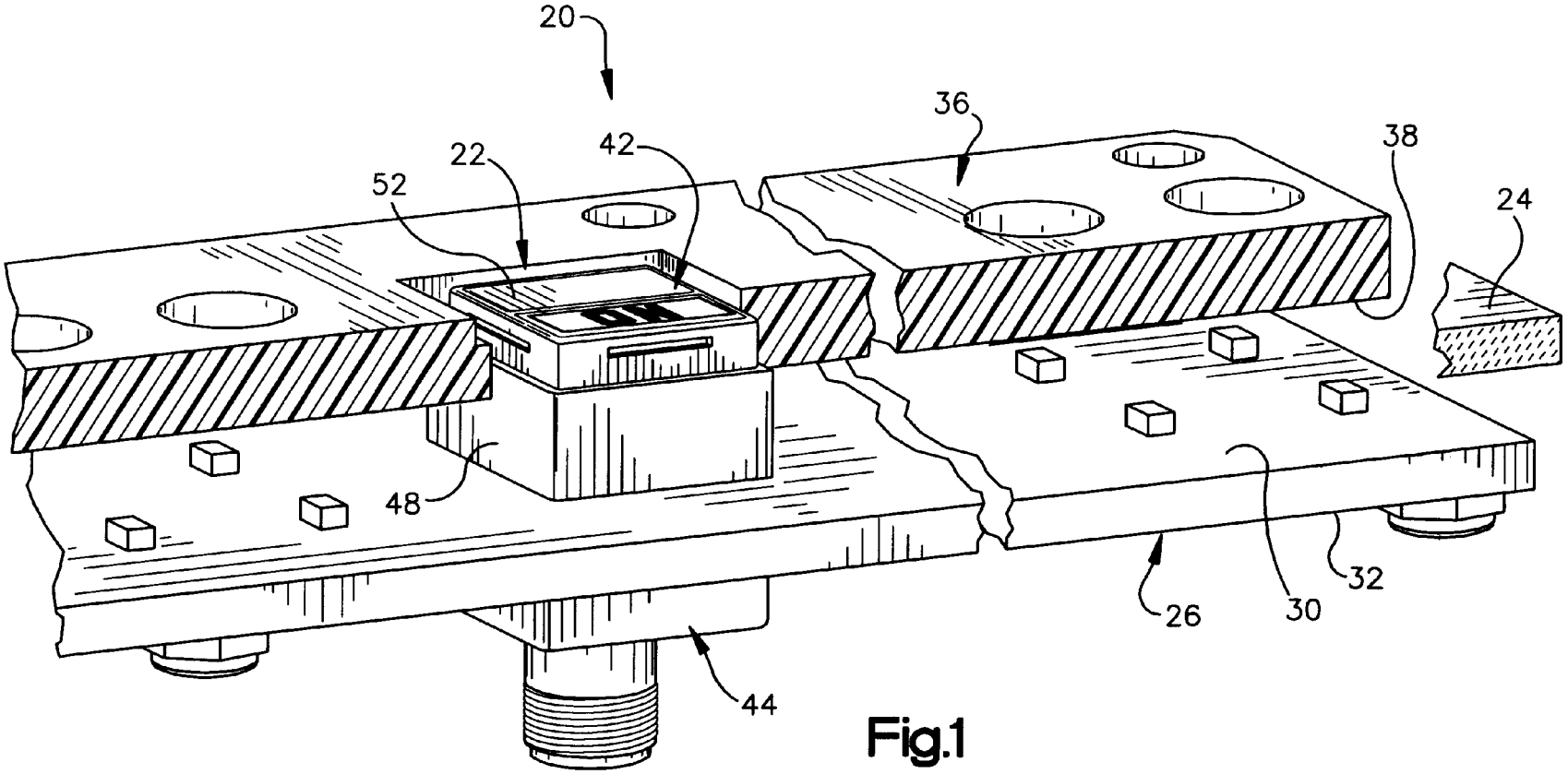
FIG. 1 is a simplified fragmentary pictorial schematic illustration of a control panel assembly with components removed and illustrating the relationship between a light plate, an instrument panel, and a circuit board.

A control panel assembly 20 (FIG. 1) includes a control apparatus 22 which is constructed and operated in accordance with the present invention. The control panel assembly 20 includes an instrument panel 24 which is fixedly connected with a frame of a vehicle, such as an aircraft. Although only a portion of the instrument panel 24 has been illustrated schematically in FIG. 1, it should be understood that the instrument panel has a known construction and forms part of the aircraft.

A circuit board 26, specifically, a printed circuit board, is fixedly connected with the instrument panel 24. The printed circuit board 26 is disposed a short distance below the instrument panel 24. The circuit board 26 has a generally known rectangular construction. A flat major upper side surface 30 of the circuit board 26 faces upward toward the instrument panel 24. Similarly, a flat lower side surface 32 of the circuit board 26 faces downward away from the instrument panel 24. The surfaces 30 and 32 of the circuit board 26 extend generally parallel to and are spaced apart from the instrument panel 24.

An opaque light plate 36 is disposed above the instrument panel 24. A flat rectangular lower side surface 38 on the light plate 36 rests on the instrument panel 24. The light plate 36 has a known construction and cooperates with the instrument panel 24 in a known manner.

The general construction of the control panel assembly 20 is well known and is utilized in association with aircraft, particularly military aircraft. It should be understood that numerous control devices have been omitted from the control panel assembly 20. It should also be understood that the circuit board 26 and/or control apparatus 22 could be utilized with many different types of control panel assemblies.

Although the circuit board 26 and control apparatus 22 are illustrated in FIG. 1 in association with a control panel assembly 24 in a vehicle, specifically, an aircraft, it is contemplated that the circuit board and control apparatus may be utilized in many different types of control systems in many different environments other than a vehicle. For example, the control apparatus 22 could be used without the circuit board 26 in a control system for a machine which is used in the manufacture of articles.

The control apparatus 22 controls electrical circuitry, not shown, connected with the circuit board 26. The control apparatus 22 includes an actuator module 42 (FIGS. 1 and 2) which is disposed above the circuit board 26 and a switch module 44 which is disposed below the circuit board 26. An opaque coupler 48 (FIG. 1) encloses the actuator module 42 and extends between the circuit board 26 and the light plate 36. The opaque coupler 48 ensures that random rays of light will not escape from the actuator module of the control apparatus 22 to the environment around the control panel assembly 20.

The control panel assembly 20 includes many different components. Depending upon the environment in which the control apparatus 22 is used, one or more of the components of the control panel assembly 20 and/or control apparatus 22 may be omitted. For example, the coupler 48 and/or light plate 36 could be omitted if desired. If desired, the control apparatus 22 could be positioned at a location spaced from the circuit board 26.

Actuator Module

Figure 2:
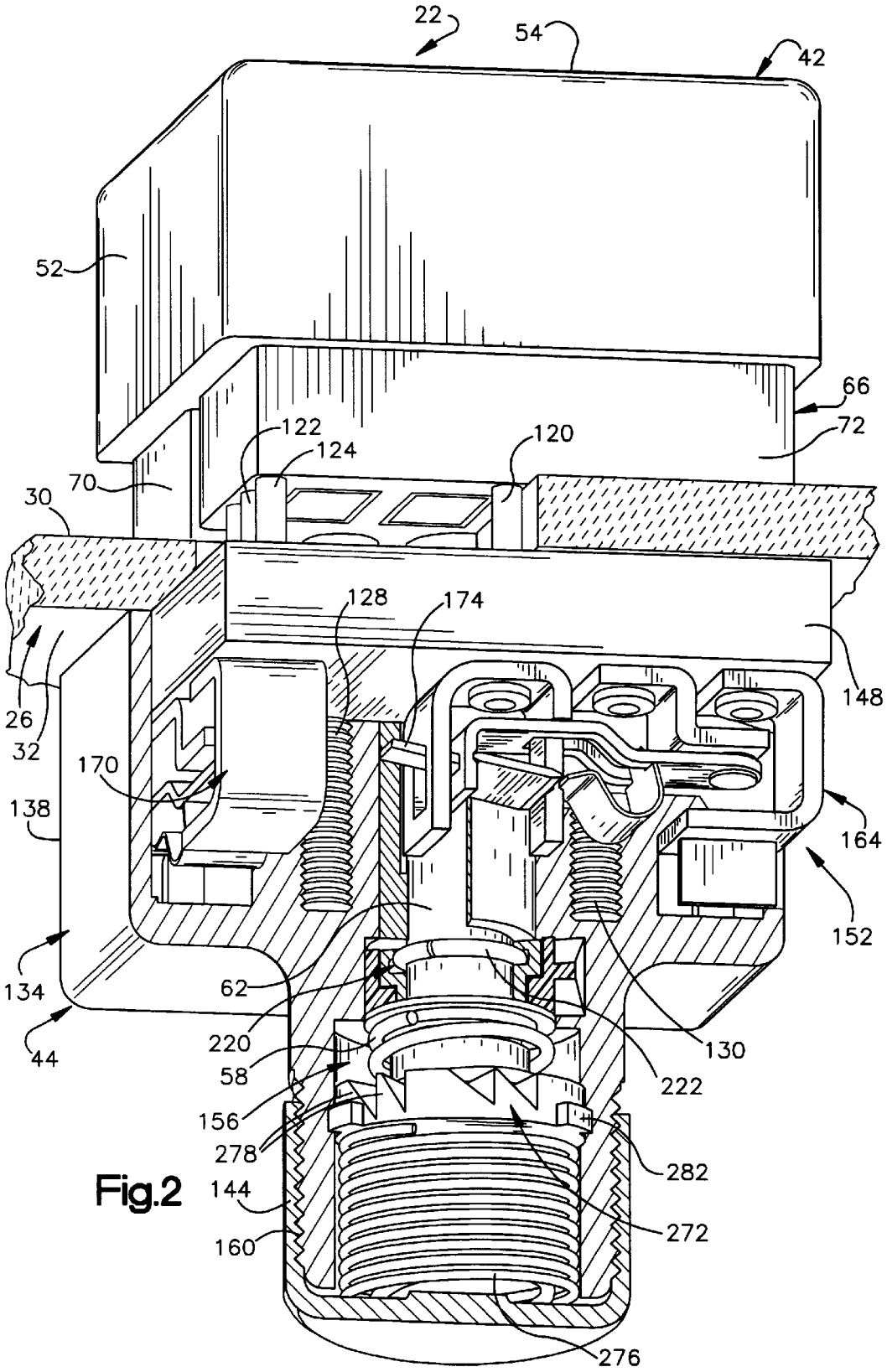
FIG. 2 is an enlarged fragmentary pictorial illustration of a control apparatus mounted on the circuit board of FIG. 1.
Figure 3:
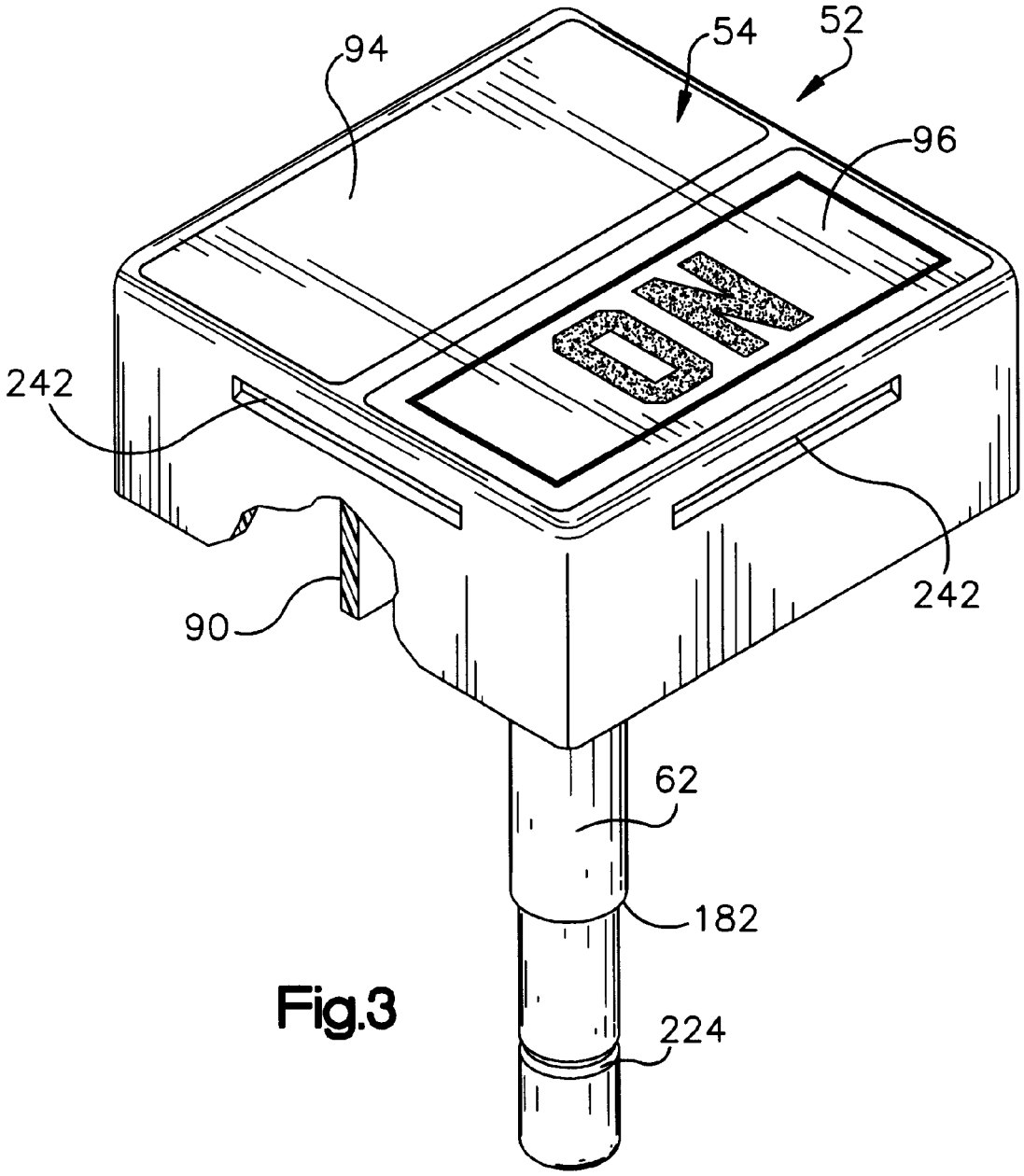
FIG. 3 is a pictorial illustration of a push button used in the control apparatus of FIG. 2.
Figure 12:
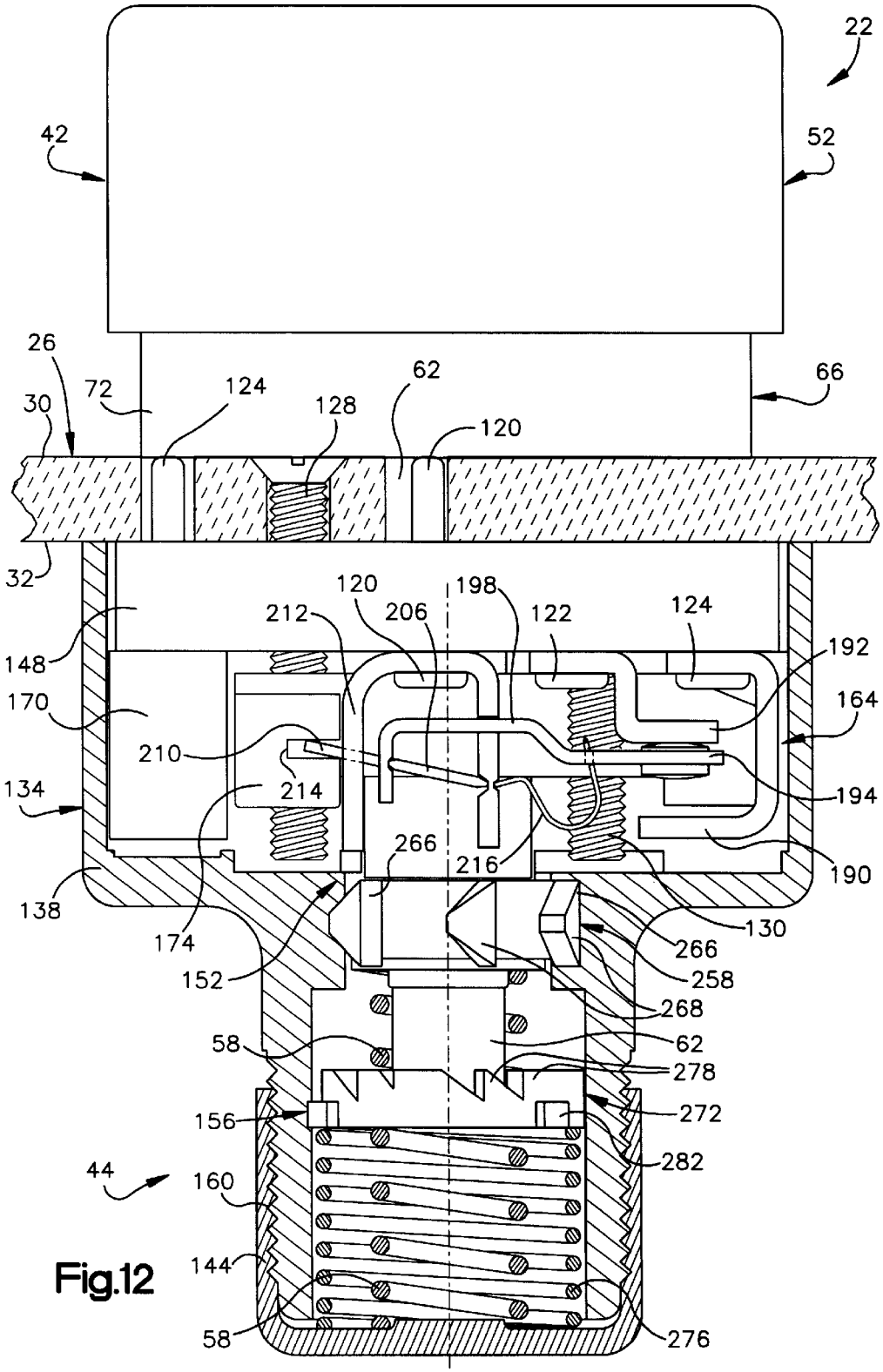
FIG. 12 is a fragmentary pictorial illustration depicting the control apparatus of FIG. 2 in an unactuated condition.

The actuator module 42 includes a manually engagable push button 52 (FIGS. 1, 2 and 3). The push button 52 is manually movable in a downward direction, that is, toward the circuit board 26, to actuate components of the switch module 44. The push button 52 is normally or initially in an unactuated position (FIGS. 2 and 12).

Figure 13:
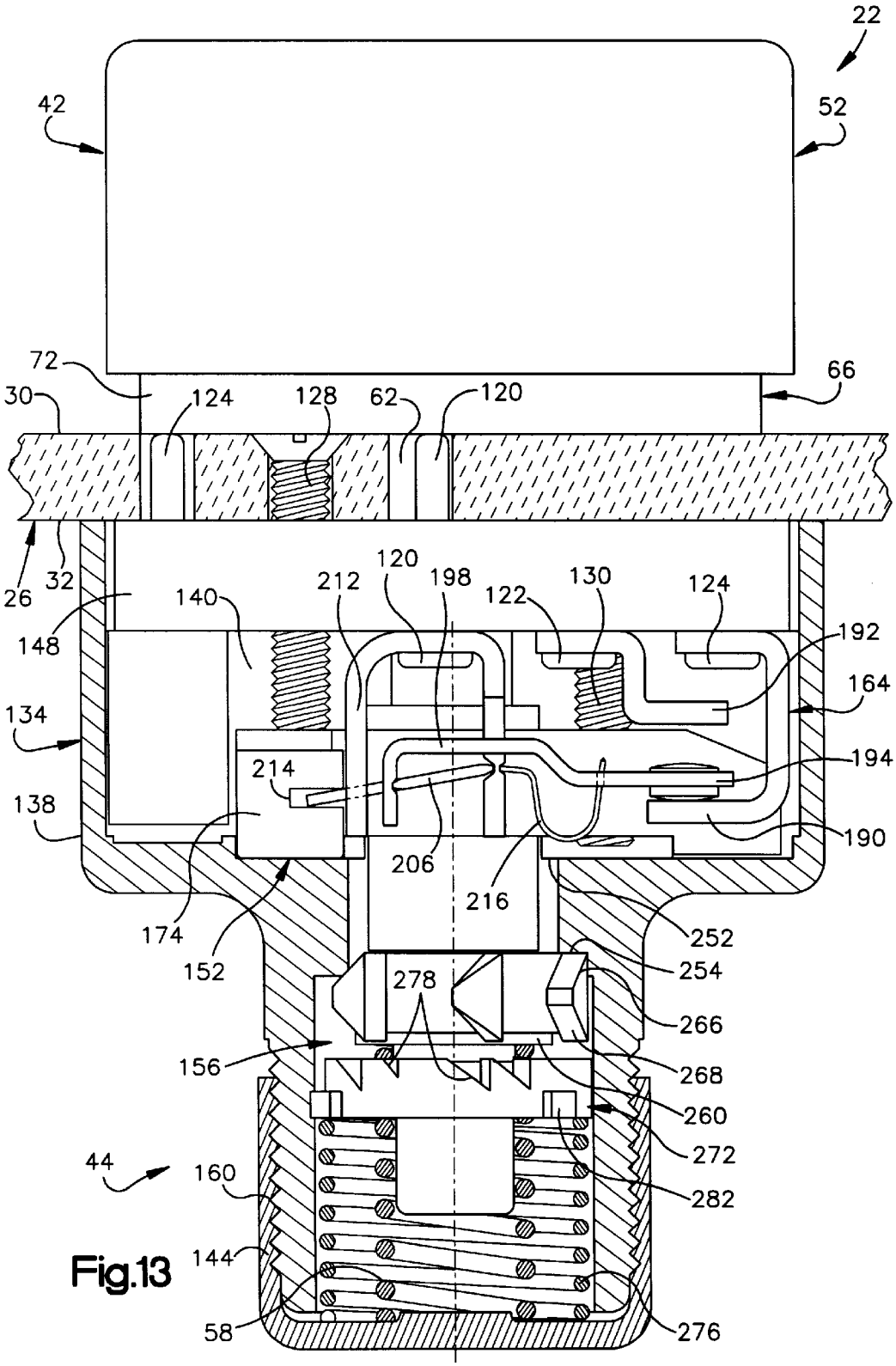
FIG. 13 is a fragmentary pictorial illustration, generally similar to FIG. 12, illustrating the control apparatus of FIG. 2 in an actuated condition.

Upon the application of manual force against a rectangular upper side surface 54 (FIG. 3), the push button 52 is moved downward (as viewed in FIG. 2) toward the circuit board 26. As this occurs, the push button 52 is moved from a raised or unactuated condition (FIGS. 2 and 12) to a depressed or actuated condition (FIG. 13). When the push button 52 is manually released, a helical main spring 58 (FIG. 2) in the switch module 44 is effective to move the push button 52 upward away from its actuated position. Although the illustrated push button 52 has a generally rectangular configuration, it should be understood that the push button could have a different configuration, such as a circular or oval configuration.

A metal force transmitting member or shaft 62 (FIG. 3) extends downward from the center of the push button 52. The force transmitting member 62 extends between the actuator module 42 and the switch module 44 (FIG. 2). When the push button 52 is moved downward, that is, toward the circuit board 26, from its unactuated position, the force transmitting member 62 transmits force from the push button 52 to the switch module 44 to effect actuation of the switch module. When the push button 52 is manually released, force is transmitted from the main spring 58 (FIG. 2) to the force transmitting member 62 to urge the push button 52 in an upward direction, that is, away from the circuit board 26. Although it is preferred to use the force transmitting member 62 to transmit force from the push button 52 to the switch module 44, the force could be transmitted in other ways if desired.

An illumination unit 66 (FIGS. 2, 4, 12 and 13) is provided to illuminate the push button 52. The illumination unit 66 and push button 52 are disposed in a telescopic relationship with each other. Although it is preferred to utilize an illumination unit 66 with the push button 52, the illumination unit could be omitted if desired.

When the push button 52 is manually depressed from the unactuated position of FIGS. 2 and 12 to the actuated position of FIG. 13, the extent of the telescopic relationship between the push button 52 and illumination unit 66 increases. Similarly, when the main spring 58 (FIG. 2) is effective to move the push button 52 from the actuated position of FIG. 13 back to the unactuated position of FIGS. 2 and 12, the telescopic relationship between the push button 52 and the illumination unit 66 decreases. The telescopic relationship between the illumination unit 66 and push button 52 minimizes the possibility of stray rays of light from the illumination unit 66 finding their way to the environment around the control apparatus 22.

The coupler 48 (FIG. 1) is opaque and extends around both the push button 52 and the illumination unit 66 to further ensure that stray rays of light from the illumination unit do not escape to the environment around the actuator module 42. The opaque coupler 48 has a light tight seal with the light plate 36 and with the circuit board 26. There is always an overlapping relationship between opaque side walls of the push button 52 and the illuminating unit 66. Therefore, it is virtually impossible for light to escape from the illumination unit 66 to the environment around the actuator module 42.

The illumination unit 66 (FIG. 4) includes a pair of generally rectangular tubular light shrouds 70 and 72 having opaque side walls which extend upward from the upper side surface 30 of the circuit board 26. The tubular light shrouds 70 and 72 are formed of an opaque material and have an open ended ring-shaped configuration. Thus, an open lower end portion 76 of the light shroud 70 is fixedly connected to the circuit board 26 and has a light tight seal with the upper side surface 30 of the circuit board. Similarly, the light shroud 72 has an open lower end portion 78 which is fixedly connected with the circuit board 26. The open lower end portion 78 of the light shroud 72 has a light tight seal with an upper side surface 30 of the circuit board 26.

A plurality of light sources 82 are surrounded by the light shroud 70. Similarly, a plurality of light sources 84 are surrounded by the light shroud 72. The light sources 82 enclosed by the light shroud 70 are effective to illuminate one half of the upper side surface 54 of the push button 52. Similarly, the light sources 84 enclosed by the light shroud 72 are effective to illuminate the other half of the upper side surface 54 of the push button 52.

Figure 4:
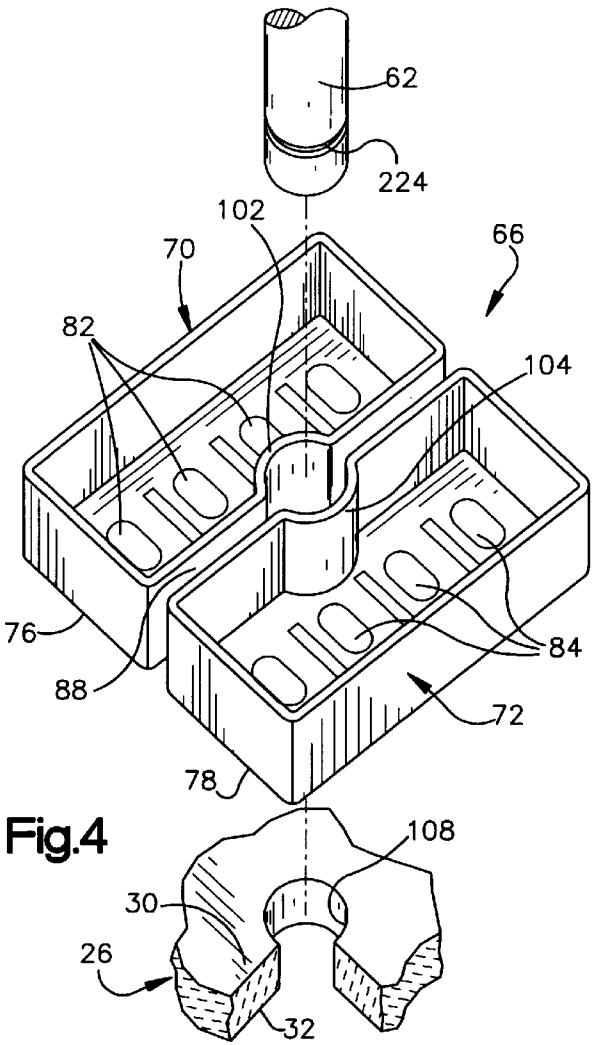
FIG. 4 is a fragmentary pictorial illustration schematically illustrating the relationship between a plurality of light sources and a light shroud which is connected with the circuit board of FIG. 1 and forms part of the control apparatus of FIG. 2.

It should be understood that even though the light sources 82 and 84 have been schematically shown in a spaced apart relationship with the circuit board 26 in FIG. 4, the light sources 82 and 84 are fixedly connected with the upper side surface 30 of the circuit board 26. The open lower end portions 76 and 78 of the light shrouds 70 and 72 have light tight seals with the upper side surface 30 of the circuit board 26.

In the illustrated embodiment of the invention, the light sources 82 and 84 are light emitting diodes. Of course, other known types of light sources could be utilized if desired. The light emitting diodes forming the light sources 82 and 84 are mounted directly on the upper side surface 30 on the circuit board 26. If desired, the light emitting diodes forming the light sources 82 and 84 could be mounted on the circuit board 26 in the same manner as is disclosed in U.S. pat. application Ser. No. 09/126,496 filed Jul. 30, 1998 by Valenzona et al. and entitled "Display Apparatus". Alternatively, the light sources could be mounted on separate panels connected to the lower end portions 76 and 78 of the light shrouds 70 and 72.

A guide slot 88 is formed between the two light shrouds 70 and 72 (FIG. 4). An opaque guide panel 90 (FIG. 3) on the push button 52 extends into the slot 88. The slot 88 and panel 90 cooperate to guide movement of the push button 52 between the actuated and unactuated positions.

The rectangular guide panel 90 is effective to divide the upper side surface 54 (FIG. 3) of the push button 52 into two sections, that is, into a first section 94 and a second section 96. Light from the light source 82 is effective to illuminate the first section 94 of the upper side surface 54 of the push button 52. Similarly, light from the light source 84 is effective to illuminate the second section 96 of the upper side surface 54 of the push button 52.

The opaque panel 90 (FIG. 3) extends into the slot 88 (FIG. 4) to prevent cross illumination of the sections 94 and 96 of the push button 52. Thus, the panel 90 cooperates with the light shrouds 70 and 72 to block illumination from the light source 82 from reaching the section 96 of the upper side surface 54 of the push button 52. The panel 90 also cooperates with the light shrouds 70 and 72 to block illumination from the light source 84 from reaching the section 94 of the push button 52.

During movement of the push button 52 between the unactuated and actuated positions, the light shrouds 70 and 72 cooperate with the guide panel 90 to guide movement of the push button. In addition, the light shrouds 70 and 72 are provided with arcuate wall sections 102 and 104 (FIG. 4) which partially enclose the force transmitting member 62. The arcuate wall sections 102 and 104 guide movement of the cylindrical force transmitting member 62 relative to the circuit board 26 during movement of the push button 52 between the unactuated and actuated positions.

A cylindrical opening 108 is formed in the circuit board 26 (FIG. 4). The force transmitting member 62 extends through the cylindrical opening 108. The opening 108 is sized so that it is just slightly larger than the cylindrical outer side surface of the force transmitting member 62. This enables the circuit board 26 to also guide movement of the cylindrical force transmitting member 62 relative to the circuit board. If desired, the force transmitting member 62, wall sections 102 and 104, and opening 108 could have a configuration which is different than the illustrated cylindrical configurations. For example, they could be polygonal or oval.

It should be understood that one or more of the previously described components of the actuator module 42 could be omitted or constructed differently if desired. For example, the light shrouds 70 and 72 could be omitted. Alternatively, the light shrouds 70 and 72 could be constructed as a single unit. If the light shrouds 70 and 72 are constructed as a single unit, they could direct light from both of the light sources 82 and 84 to the entire upper side surface 54 of the push button 52. Of course, if the light shrouds 70 and 72 are a single unit, they could be constructed so as to cooperate with the panel 90 so that each light source 82 or 84 is effective to illuminate only a portion of the upper side surface 54 of the push button 52.

Switch Module

The switch module 44 (FIGS. 2 and 5) is mounted beneath the circuit board 26. The switch module 44 includes a plurality of groups 112, 114, 116, and 118 (FIG. 5) of terminals. Each of the groups 112, 114, 116, 118 of terminals includes three terminals 120, 122 and 124. However, it should be understood that either a greater or lesser number of terminals could be provided in each group 112, 114, 116, and 118 of terminals and that a greater or lesser number of groups of terminals could be provided.

The groups 112, 114, 116 and 118 of terminals (FIG. 5) are arranged in a rectangular array around coincident central axes of the force transmitting member 62 and switch module 44. However, the groups of terminals could be arranged differently if desired. For example, the groups 112, 114, 116 and 118 of terminals could be arranged in a circular or oval array.

The terminals 120, 122 and 124 in each group 112, 114, 116, and 118 of terminals are received in metal sockets (not shown) disposed in cylindrical openings 126 (FIG. 12) in the circuit board 26. The sockets are connected with suitable control circuits. A pair of mounting screws 128 and 130 (FIGS. 2, 12 and 13) extend through the circuit board 26 into the switch module 44 to connect the switch module with the circuit board 26.

Since the switch module 44 is connected with sockets in the circuit board 26 by the terminals 112, 114, 116 and 118, it is relatively easy to replace the switch module. To replace the switch module 44, it is necessary to disconnect the mounting screws 128 and 130 and pull the switch module downward away from the circuit board 26. This results in the terminals 112, 114, 116 and 118 being disconnected from the mating sockets in the circuit board.

A replacement switch module can then be installed in place of the switch module 44. The replacement switch module may have the same construction or a different construction than the original switch module 44. Although it is believed that the mounting screws 128 and 130 will be utilized to promote a solid connection with the circuit board 26, the mounting screws may be eliminated and the switch module 44 and/or replacement switch module connected to the circuit board by the terminals 112, 114, 116 and 118 without the mounting screws.

The switch module 44 includes a metal housing 134 (FIG. 2). The housing 134 is fixedly connected with the circuit board 26 by the mounting screws 128 and 130. If desired, the housing 134 could be formed of a material other than metal. For example, the housing 134 could be formed of a suitable polymeric material.

The housing 134 includes a main section 138 (FIGS. 2, 5, and 11) which is integrally formed as one piece. The main section 138 (FIG. 11) of the housing includes a pair of upstanding cylindrical posts 140 and 142 which are internally threaded to receive the mounting screws 128 and 130 (FIG. 2). The housing 134 includes a removable closure or cap 144 (FIG. 2) which is threaded onto the main section of the housing. The closure for the opening which provides access to the interior of the housing could be formed by a member other than the cap 144. For example, a plate could be connected with the housing by threaded fasteners or a suitable snap connection. Alternatively, the housing 134 could be formed in two sections.

In addition, a rectangular end wall 148 (FIGS. 2 and 5) is fixedly connected to the main section 138 of the housing 134. The end wall 148 is formed of an electrically insulating material. If desired, the end wall 148 could be formed as one piece with the housing 134.

A switch mechanism 152 (FIG. 2) is enclosed by the housing 134. The switch mechanism 152 is operable between an unactuated condition and an actuated condition in response to actuation of the push button 52. The switch mechanism 152 is connected with the push button 52 by the force transmitting member 62. Although a specific switch mechanism 152 has been illustrated and will be described herein, a different switch mechanism could be used if desired.

The switch mechanism 152 is connected with electrical circuitry on the circuit board 26 by the groups 112, 114, 116 and 118 (FIG. 5) of terminals 120, 122 and 124. In the illustrated embodiment of the invention, the groups 112, 114, 116 and 118 of terminals extend through the electrically insulating end wall 148 (FIGS. 2 and 5) of the housing 134. However, the end wall 148 could be omitted and the switch mechanism 152 mounted directly on the circuit board 26 if desired. It is believed that by enclosing the switch mechanism 152 in the housing and having the groups 112–118 of terminals engage sockets on the circuit board 26, mounting of the switch module 44 on the circuit board 26 may be facilitated.

A switch action mechanism 156 (FIGS. 2, 7, 12, and 13) is disposed in the housing 134 and is connected with the switch mechanism 152. The switch action mechanism 156 determines the type of switching action with which the switch mechanism 152 operates. The switch action mechanism 156 may be constructed so as to give the switch mechanism 152 any desired operating characteristic. Thus the switch action mechanism 156 could be constructed so as to impart alternate action, momentary action, indicator characteristics, or any other known type of action or characteristics to the switch mechanism 152.

In the illustrated embodiment of the invention, the switch action mechanism 156 (FIG. 2) is of the alternate action type. Therefore, when the push button 54 is manually moved downward, toward the circuit board 26, the switch mechanism 152 is operated from an unactuated condition to an actuated condition. When the push button 52 is manually released, the switch mechanism 152 remains in the actuated condition. Even though the switch mechanism 152 remains in the actuated condition, the push button 52 moves at least part way back to its initial or unactuated position.

When the push button 52 is again manually actuated, the push button 52 is again moved downward (as viewed in FIG. 2) toward the circuit board 26. At this time, the switch mechanism 152 remains in the actuated condition. When the push button 52 is manually released, the push button moves back to its unactuated position and the switch mechanism 152 is operated to its unactuated condition. The switch action mechanism 156 is connected with the switch mechanism 152 and the push button 52 by the force transmitting member 62.

The light sources 82 and 84 may be energized as functions of the condition of the switch mechanism 156. Thus, the light source 82 may be energized when the switch mechanism 156 is in an unactuated condition. The light source 84 may be energized when the switch mechanism is in an actuated condition. Of course, the light sources 82 and 84 could be energized and de-energized in response to other control functions if desired.

Although the illustrated switch action mechanism 156 is of the alternate action type, the switch action mechanism could be of a different type if desired. For example, the switch action mechanism 156 could be of the momentary action type. When the switch action mechanism 156 is of the momentary action type, the switch mechanism 152 is operated from its is unactuated condition to its actuated condition whenever the push button 52 is manually depressed. When the push button 52 is manually released, the switch mechanism 152 is operated from its actuated condition to its unactuated condition. Thus, when the switch action mechanism 156 is of the momentary type, the switch mechanism 152 remains in its actuated condition only while the push button 52 is manually depressed.

The switch action mechanism 156 could be of a type to convert the switch mechanism 152 to an indicator. In such an arrangement, the switch action mechanism 156 would block movement of the push button 52 relative to the circuit board 26. The push button would then function as an indicator. The light sources 82 and 84 (FIG. 4) would be operated in response to circuitry connected with the circuit board 26 to illuminate the push button 52 to provide an indication to an observer. The push button 52 would be held against movement relative to the circuit board and would merely function as an indicator unit.

The housing 134 can be opened to provide access to the switch action mechanism 156. This enables the switch action mechanism 156 to be changed to change the operating characteristics of the switch mechanism 152. For example, switch actuation mechanism 156 may be changed from the illustrated alternate action mechanism to a momentary action mechanism. Alternatively, the switch action mechanism 156 may be changed to change the operating characteristics of the switch mechanism 152 to an indicator.

To obtain access to the interior of the housing 134, the cap 144 is rotated to loosen a threaded connection 160 (FIG. 2) between the cap and the main section 138 of the housing. When the cap 144 has been disconnected from the main section 138 of the housing 134, the components of the switch action mechanism 156 can be changed to change the operating characteristics of the switch mechanism 152.

Although the switch mechanism 152 may be changed between an alternate action switch mechanism and a momentary action switch mechanism by opening the housing 134 and changing one or more components of the switch action mechanism 156, the change between an alternate action switch mechanism and a momentary action switch mechanism may be effected by replacing the switch module 44. As was previously mentioned, changing the switch module 44 requires disconnecting the mounting screws 128 and 130 and disconnecting the terminals 112, 114, 116, and 118 from the circuit board 26. However, it is believed that in some circumstances it will be preferred to change the operating characteristics of the switch mechanism by merely opening the housing 134 and changing one or more components of the switch action mechanism 156 while the main section 138 of the housing remains connected with the circuit board by the mounting screws 128 and 130 and the terminals 112, 114, 116, and 118.

Switch Mechanism

Figure 6:
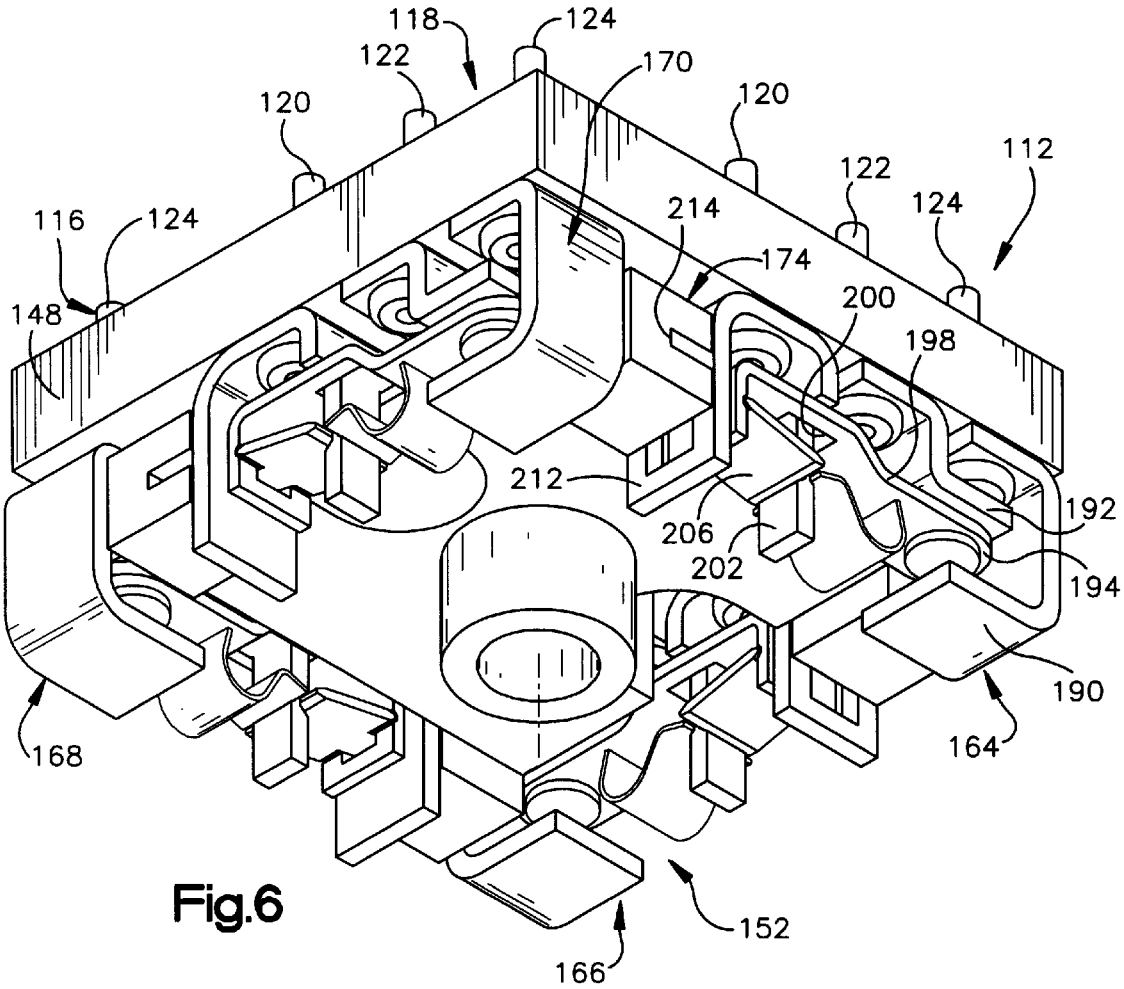
FIG. 6 is a pictorial illustration depicting the relationship between a plurality of switch units and an actuator link in the switch module of FIG. 5.

The switch mechanism 152 includes a plurality of switch units 164, 166, 168, and 170 (FIG. 6). The switch units 164, 166, 168 and 170 are disposed in a rectangular array around the force transmitting member 62. The switch units 164, 166, 168 and 170 are fixedly connected with the end wall 148 of the housing 134.

Figure 5:
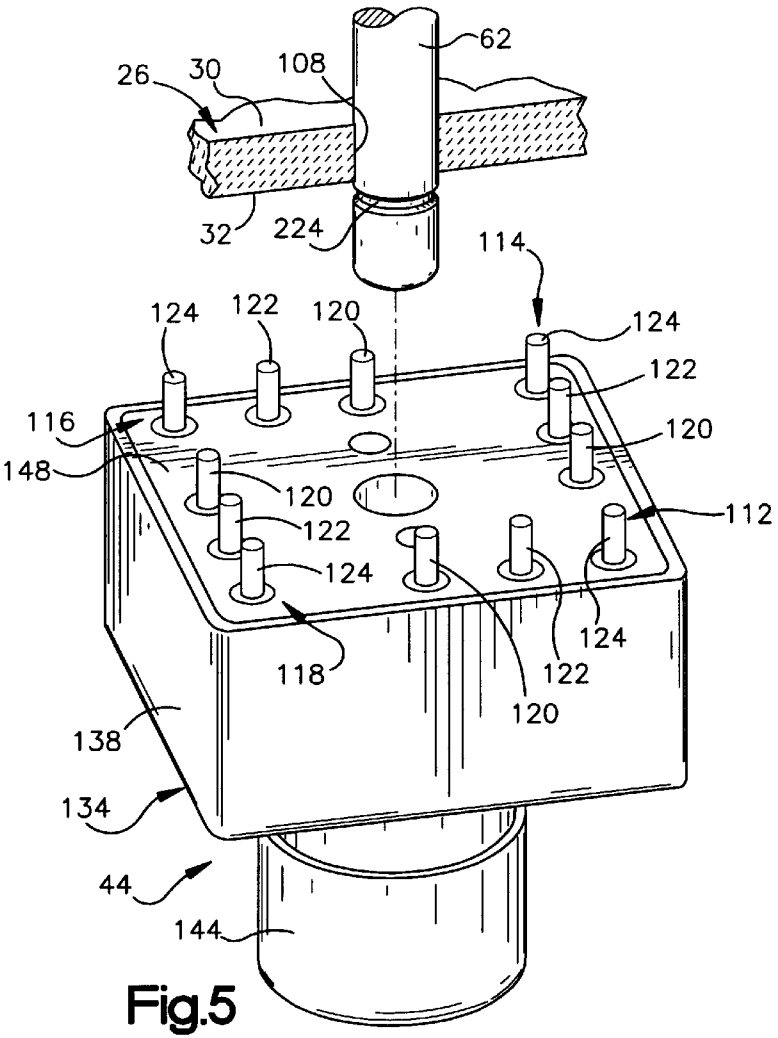
FIG. 5 is a fragmentary schematic pictorial illustration of a switch module having terminals which are connected with the circuit board of FIG. 1.

The switch units 164–170 are each connected with one of the groups 112, 114, 116 or 118 (FIG. 5) of terminals 120, 122 and 124. Thus, the switch unit 164 is connected with the group 112 of terminals (FIGS. 5 and 6). Similarly, the switch unit 166 is connected with the group 114 of terminals. The switch unit 168 is connected with the group 116 of terminals. Finally, the switch unit 170 is connected with the group 118 of terminals.

An actuator link 174 is connected with the switch units 164–170. The actuator link 174 has a rectangular configuration and has a central axis which is coincident with the central axis of the force transmitting member 62. The rectangular array of switch units 164–170 extends around the actuator link 174.

Figure 8:
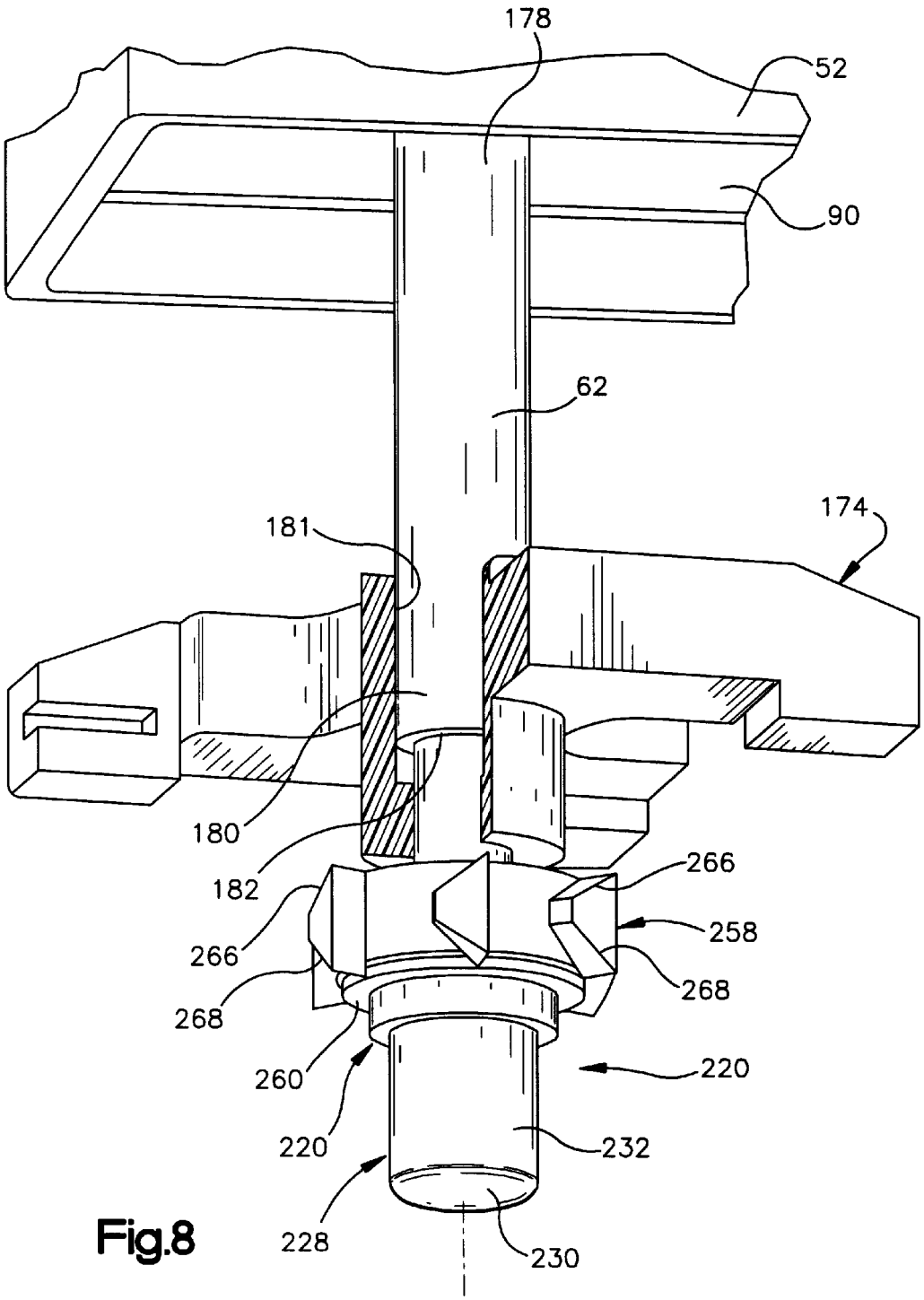
FIG. 8 is an enlarged fragmentary schematic pictorial illustration depicting the manner in which the actuator link of FIG. 6 is mounted on a force transmitting member which extends through the circuit board of FIG. 1 and is connected with the push button and the switch action mechanism.

The actuator link 174 is formed of an electrically insulating material and is connected with the push button 52 by the force transmitting member 62 (FIG. 8). An upper or first end portion 178 of the force transmitting member 62 is disposed above the circuit board 26 (FIG. 2) and is fixedly connected with the push button 52 (FIG. 8). A lower or second end portion 180 of the force transmitting member 62 is disposed below the circuit board 26 in the housing 134. An intermediate portion 179 of the force transmitting member 62 is disposed between the upper and lower end portions 178 and 180 of the force transmitting member and extends through the opening 108 (FIG. 4) in the circuit board 26. The lower end portion 180 of the metal force transmitting member 62 extends through a central opening 181 (FIG. 8) in the actuator link 174.

The lower end portion of the cylindrical force transmitting member 62 has an annular shoulder 182 which is pressed against the actuator link 174. The actuator link 174 is moved downward, that is, in a direction away from the circuit board 26, when the push button 54 is depressed. Thus, the shoulder 182 on the force transmitting member 62 transmits force from the push button 52 in the actuator module 42 disposed above the circuit board 26 to the actuator link 174 in the switch module 44 disposed below the circuit board 26.

The switch units 164–170 are disposed in a rectangular array (FIG. 6) which extends around the force transmitting member 62. Each of the switch units 164–170 in the rectangular array of switch units is connected with the actuator link 174. Therefore, movement of the actuator link 174 by the force transmitting member 62 is effective to actuate each of the switch units 164–170 between an unactuated condition and an actuated condition.

In the embodiment of the invention illustrated in FIG. 6, there are four switch units 164–170 disposed in a rectangular (square) array. However, it should be understood that there could be a greater or lesser number of switch units if desired. For example, the switch mechanism 152 could be constructed so as to include only a single switch unit, such as the switch unit 164. Alternatively, the switch mechanism 152 could be constructed so as to have a greater number of switch units, such as eight or ten switch units.

In the embodiment of the invention illustrated in FIG. 6, the switch units 164–170 are all disposed in a single layer which is connected with the electrically insulating end wall 148 of the housing 134. However, the switch units could be disposed on several different layers which are vertically offset from each other along the force transmitting member 62. For example, there could be two layers of four switch units each. Each of the two layers of four switch units could have the same construction as the switch mechanism 152. A separate actuator link 174 could be provided for each of the layers of switch units. Alternatively, a single actuator link could be provided to actuate switch units in two or more layers.

In the embodiment of the invention illustrated in FIG. 6, the switch units 164–170 are disposed in a rectangular array that is square. However, the switch units could be disposed in an oblong array containing a greater number of switch units. For example, six or eight switch units could be arranged in a rectangular, circular or oval array. If six switch units were arranged in an oval array, three switch units could be provided in an arcuate row along one side of the force transmitting member 62 and three switch units could be provided in an arcuate row along the opposite side of the force transmitting member 62.

In the illustrated embodiment of the invention, the actuator link 174 has a rectangular, generally square, configuration. However, the actuator link 174 could have a different configuration if desired. For example, the actuator link 174 could have a circular or oval configuration if desired. Although only a single force transmitting member 62 is utilized to actuate the switch mechanism 152, it should be understood that a plurality of force transmitting members could be provided if desired.

Figure 7:
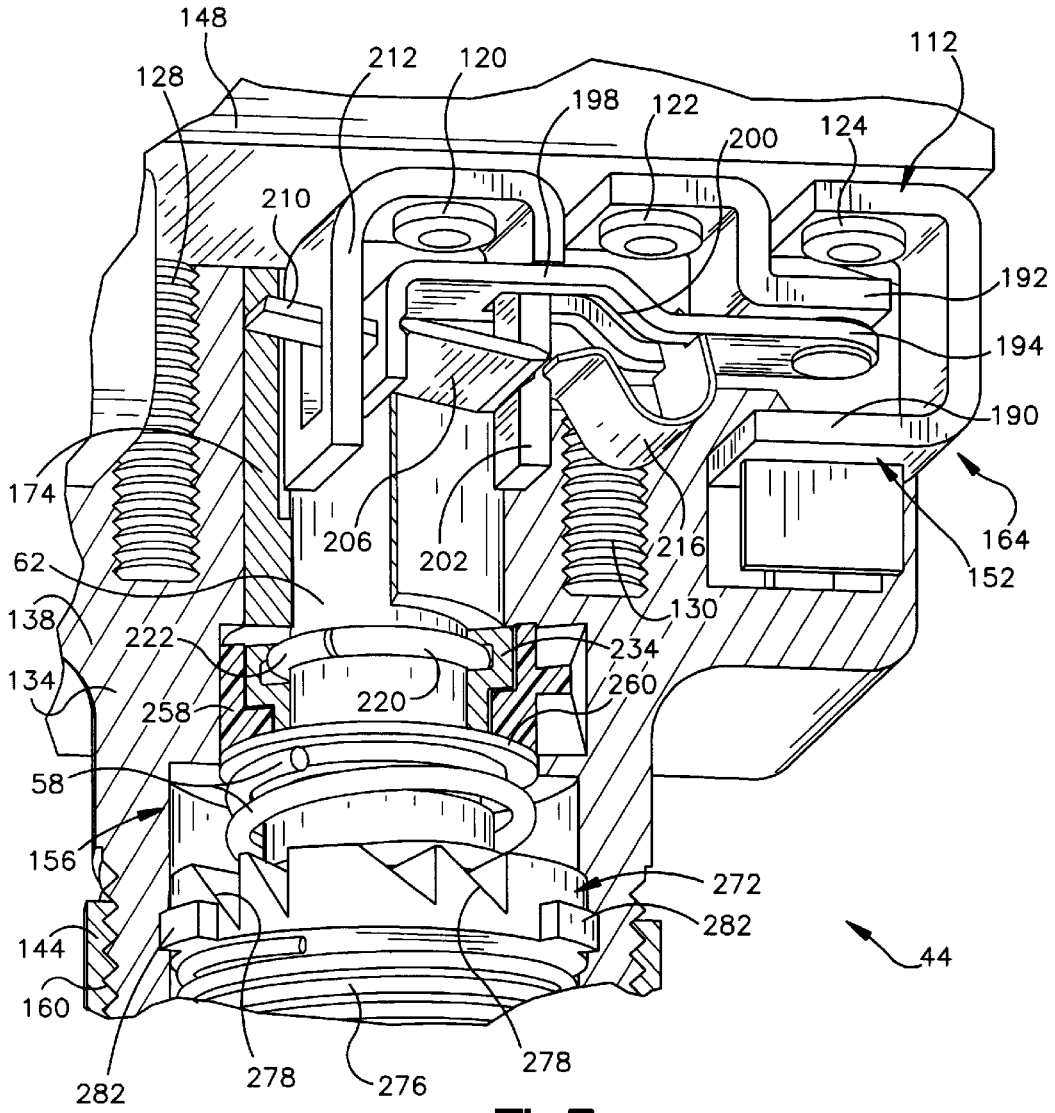
FIG. 7 is an enlarged fragmentary pictorial illustration of a portion of FIG. 2 and illustrating one of the switch units and a switch action mechanism of the alternate action type.

The illustrated switch unit 164 includes a stationary switch contact 190 (FIG. 7) which is connected with the terminal 124 in the group 112 of terminals (FIGS. 6 and 7). A second stationary switch contact 192 (FIG. 7) is connected to a second terminal 122 in the group 112 of terminals. A movable switch contact 194 is connected with a terminal 120 in the group of terminals 112.

The movable switch contact 194 is movable between an unactuated position, illustrated in FIGS. 6 and 7, in which an upper side of the movable contact engages the stationary contact 192. When the movable contact 194 is in the unactuated position of FIGS. 6 and 7, the terminal 120 is electrically connected with the terminal 122 through the stationary switch contact 192 and movable switch contact 194. At this time, the stationary switch contact 190 is electrically connected with only the terminal 124.

When the switch unit 164 is operated to the actuated condition, a lower side of the movable switch contact 194 moves into engagement with the stationary switch contact 190. This results in the terminal 120 being connected with the terminal 124 through the stationary switch contact 190 and the movable switch contact 194. At this time, the stationary switch contact 192 is electrically connected with only the terminal 122.

The movable contact 194 (FIGS. 6 and 7) is disposed on an actuator lever 198. The actuator lever 198 has an elongated central opening 200 through which a pivot post 202 extends. A pivot link 206 has a right (as viewed in FIGS. 6 and 7) end portion which is disposed in pivotal engagement with the pivot post 202 and a left end portion 210 (FIG. 7) which extends through an opening in a pivot lever guide post 212. The left end portion 210 of the pivot link 206 extends into a slot 214 in the actuator link 174 (FIG. 6).

The pivot lever guide post 212 (FIG. 7) is integrally formed as one piece with the pivot post 202. Both the pivot post 202 and the pivot lever guide post 212 are connected with the terminal 120. The left end portion 210 of the pivot lever 206 is movable relative to the pivot lever guide post 212 to effect movement of the actuator lever 198 between the unactuated position of FIGS. 7 and 12 in which the movable contact 194 engages the stationary contact 192 and an actuated position of FIG. 13 in which the movable contact 194 engages the stationary contact 190.

When the pivot lever 206 is pivoted in a counterclockwise direction about its right (as viewed in FIG. 7) end portion by downward movement of the left end portion 210 of the pivot lever, the actuator lever 198 is shifted downward. This downward shifting movement of the actuator lever 198 moves the movable contact 194 from a position engaging the stationary contact 192 (FIG. 12) to a position engaging the stationary contact 190 (FIG. 13). The left end portion 210 (FIG. 7) of the pivot lever 206 extends into a slot 214 (FIG. 6) in the actuator link 174. Therefore, downward movement of the actuator link 174 pivots the pivot lever 206 in a counterclockwise direction as viewed in FIG. 7.

When the actuator lever 198 is in the unactuated position shown in FIG. 7 with the movable switch contact 194 in engagement with the stationary switch contact 192, an actuator lever spring 216 provides a biasing force urging the actuator lever 198 to pivot in a counterclockwise direction (as viewed in FIG. 7) about an end portion of the actuator lever 198 engaged by the pivot lever 206. This force presses the movable switch contact 194 against the stationary switch contact 192. In addition, the actuator lever spring 216 applies a force against the actuator lever 198 urging the actuator lever toward the right (as viewed in FIG. 7). This results in the actuator lever 198 being pressed firmly against the pivot lever 206.

When the movable switch contact 194 is to be moved from the unactuated position of FIGS. 7 and 12 to the actuated position of FIG. 13, the actuator link 174 is moved downward (as viewed in FIG. 7). The pivot lever 206 is pivoted in a counterclockwise direction about its right (as viewed in FIG. 7) end portion by the actuator link 174. As this occurs, the left (as viewed in FIG. 7) end portion of the actuator lever 198 is moved downward (as viewed in FIG. 7).

When the pivot lever 206 has been moved to a horizontal (as viewed in FIG. 7) position, the actuator lever spring 216 is ineffective to resist movement of the actuator lever 198. The next increment of counterclockwise pivotal movement of the pivot lever 206 about its right (as viewed in FIG. 7) end portion results in the actuator lever spring 216 being moved to an over-center condition. As this occurs, the actuator lever spring 216 urges the movable contact 194 toward the stationary contact 190 with a snap action. The actuator lever spring 216 is effective to pivot the actuator lever 198 in a clockwise direction (as viewed in FIG. 7) about the connection with the pivot lever 206. This results in the movable switch contact 194 moving quickly downward into engagement with the stationary contact 190 (FIG. 13). As this occurs, the pivot lever 206 moves from an upward and leftward (as viewed in FIG. 7) sloping orientation to a downward and leftward sloping orientation (FIG. 13).

The general construction and mode of operation of the switch unit 164 is the same as disclosed in U.S. Pat. No. 5,659,162 issued Aug. 19, 1997 to Roy L. Hart and entitled "Switch Assembly". The disclosure in the aforementioned U.S. Pat. No. 5,659,162 is hereby incorporated herein in its entirety by this reference thereto. It should be understood that the switch unit 164 could have a different construction if desired. For example, the switch unit 164 could have a construction similar to that in U.S. Pat. No. 3,315,535.

The switch units 166, 168 and 170 have the same construction and mode of operation as the switch unit 164. Although the switch units 164–170 are of the mechanical type having movable switch contacts, it is contemplated that the switch units 164–170 could have a different construction if desired. For example, the switch units 164–170 could use photoelectric or Hall effect sensors in place of switch contacts. It should be understood that any known switch mechanism could be utilized in place of the specific switch units 164–170 disclosed herein. One known switch mechanism using Hall effect sensors is disclosed in U.S. Pat. No. 5,861,796.

Releasable Connector

The force transmitting member 62 (FIGS. 2 and 8) interconnects the push button 52 and the components of the switch module 44. Among the components of the switch module 44 which are connected with the push button 52 through the force transmitting member 62 are the actuator link 174 and the switch action mechanism 156 (FIG. 2). However, it is contemplated that it may be desired to change the push button 52, or the switch module 44, or the components of the switch module. To facilitate making of these changes, a releasable connector 220 (FIGS. 8 and 9) is provided to connect the force transmitting member 62 with components of the switch module 44.

Figure 9:
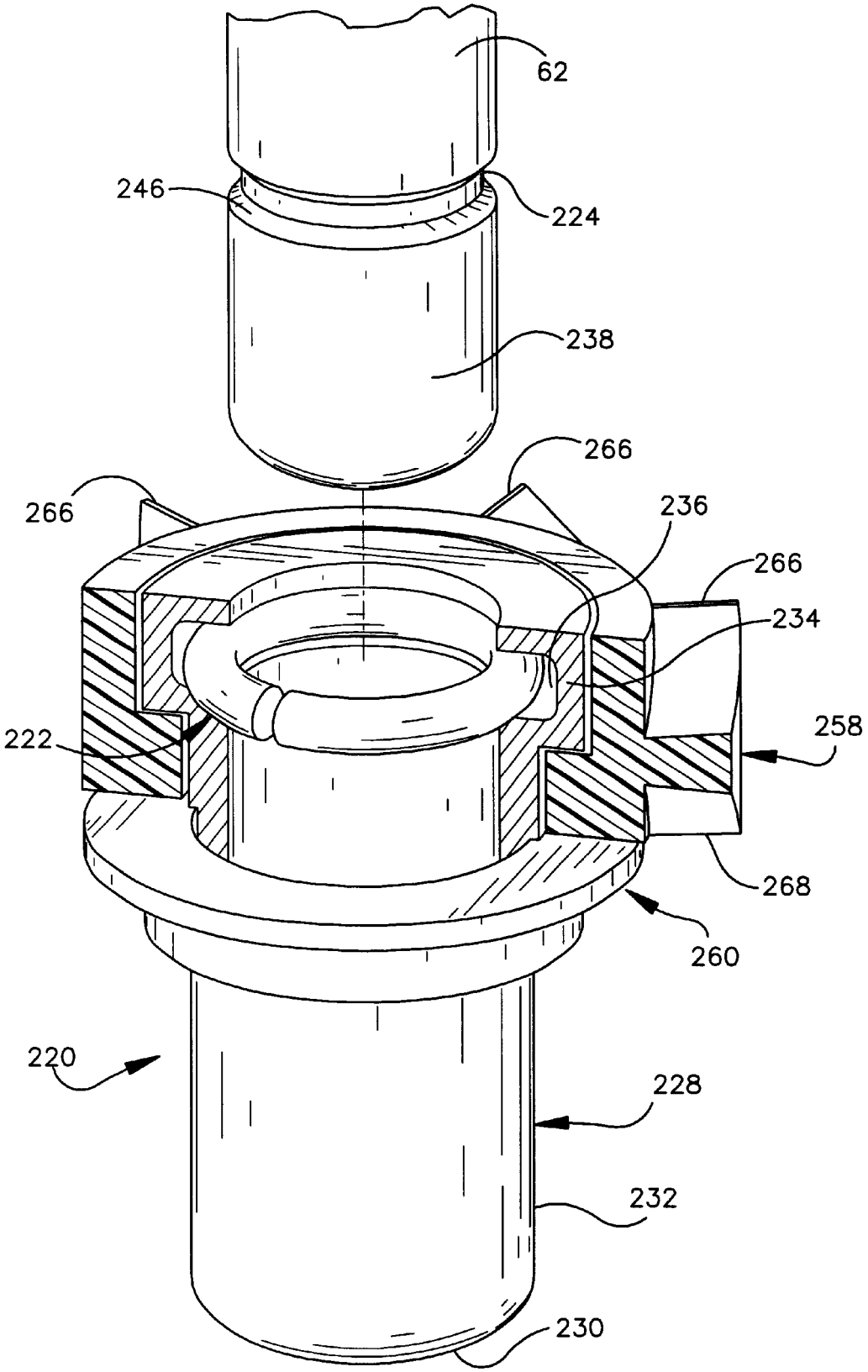
FIG. 9 is a partially exploded fragmentary schematic pictorial illustration depicting the relationship between an end portion of the force transmitting member and a releasable connector which connects the force transmitting member with the switch actuator link of FIG. 8 and the switch action mechanism.
Figure 10:
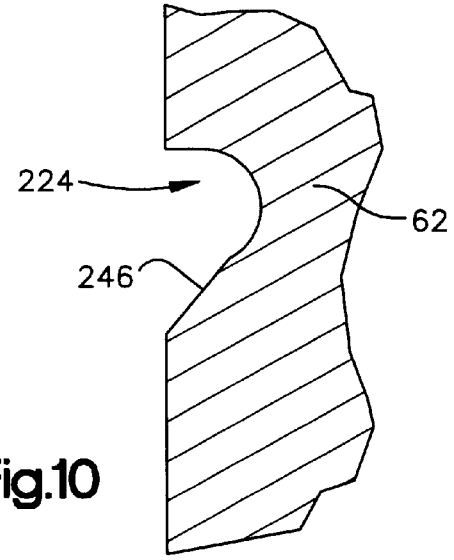
FIG. 10 is a fragmentary schematic sectional view illustrating the construction of a groove which is formed in the force transmitting member of FIG. 9.

The releasable connector 220 includes a resilient member 222 which grips the force transmitting member 62 (FIGS. 7 and 9). The resilient member 222 has a circular configuration and engages an annular groove 224 (FIGS. 9 and 10) formed in the force transmitting member 62. The resilient member 222 is resiliently deflectable to a radially expanded condition in which the resilient member slides over the leading end portion of the force transmitting member 62 to the groove 224. When the resilient member 222 is moved into radial alignment with the groove 224, the resilient member 222 contracts and tightly grips the groove 224.

In the illustrated embodiment of the invention, the resilient member 222 has a toroidal configuration (FIG. 9). However, it is contemplated that the resilient member 222 could have a different configuration if desired. For example, the resilient member 222 could be formed by a clip having linear legs. The resilient member 222 could be formed by any known type of connector member which is releasable and would be effective to engage the force transmitting member 62.

The resilient member 222 connects a cup-shaped bushing 228 (FIGS. 8 and 9) with the force transmitting member 62. The cup-shaped bushing 228 has a circular bottom wall 230 with a cylindrical side wall 232 which extends upward (as viewed in FIG. 9) from the bottom wall 230. The side wall 232 extends upward to an annular rim portion 234.

The rim portion 234 defines an annular groove 236 (FIG. 9) in which the resilient member 222 is disposed. The groove 236 is larger than the resilient member 222. This enables the resilient member to be radially expanded by insertion of a leading end portion 238 of the force transmitting member 62 into the resilient member 222.

When the resilient member 222 engages the groove 224 in the force transmitting member 62, the cup-shaped bushing 228 is held against axial movement relative to the force transmitting member. To disengage the cup-shaped bushing 228 from the force transmitting member 62, it is merely necessary to apply an upwardly directed force to grooves 242 (FIG. 3) in the push button 52. This upwardly directed force pulls the force transmitting member 62 upward out of the cup-shaped bushing 228.

The cup-shaped bushing 228 is held against upward movement by engagement with the actuator link 174 (FIGS. 7 and 8). The actuator link 174 is firmly pressed against the end wall 148 (FIG. 7) of the housing 134. Therefore, upward force applied to the grooves 242 in the push button 52 is effective to pull the force transmitting member 62 out of the cup-shaped bushing 228.

As the force transmitting member 62 is pulled upward (as viewed in FIGS. 7 and 9) relative to the cup-shaped bushing 228 (FIG. 9) by force applied to the push button 52, an annular cam surface 246 (FIG. 10) on the force transmitting member 62 is effective to apply force against the resilient member 222 (FIG. 9). The force applied by the cam surface 246 is effective to radially expand the resilient member 222. Radial expansion of the resilient member 222 enables the end portion 238 of the force transmitting member 62 to move out of the circular opening formed by the resilient member 222.

When the releasable connector 220 engages the force transmitting member 62, the releasable connector is effective to hold the actuator link 174 (FIG. 8) on the force transmitting member 62. Although one specific type of releasable connector 220 has been described herein, it should be understood that the releasable connector 220 could have a different construction if desired. Although the releasable connector 220 includes the resilient member 222, it is contemplated that a releasable connector which does not include a resilient member could be used to interconnect the force transmitting member 62 and components of the switch module 44.

The releasable connector 220 enables the switch module 44 to be easily disconnected from the actuator module 42 when the switch module 44 is to be replaced. To replace the switch module 44, the push button 52 is pulled upward, from its unactuated position, to operate the releasable connector 220 from an engaged condition to a disengaged condition. The mounting screws 128 and 130 are then disconnected from the housing 134. The housing 134 is then pulled downward to disconnect the terminals 112, 114, 116, and 118 from sockets in the circuit board 26.

Switch Action Mechanism The switch action mechanism 156 (FIGS. 2 and 7) is of the alternate action type. Therefore, the switch action mechanism 156 is effective to maintain the switch units 164–170 in an actuated condition in response to a first depression and subsequent release of the push button 52. The switch units 164–170 are operated to an unactuated condition in response to a second or next succeeding depressing and release of the push button 52.

The switch action mechanism 156 includes upper index or release positions 252 (FIG. 11) formed by upper retainer surfaces and lower index or retaining positions 254 formed by lower retainer surfaces. The retainer surfaces of the upper and lower index positions 252 and 254 are formed in the main section 138 of the housing 134. Although it may be preferred to form the upper and lower index positions 252 and 254 as one piece with the main section 138 of the housing 134, the upper and lower index positions 252 and 254 could be formed on a member which is inserted into the housing if desired. Thus, a tubular sleeve on which the upper and lower index positions 252 and 254 are formed could be inserted into a smooth bore in the housing 134.

A rotor or retainer member 258 (FIGS. 8 and 9) extends around the cup-shaped bushing 228 and is rotatable relative to the cup-shaped bushing. The annular rotor or retainer member 258 (FIG. 9) is held between an annular mounting ring 260 and the annular rim portion 234 on the cup-shaped bushing 228. Although the rotor 258 is held between the mounting ring 260 and the rim portion 234 of the bushing 228, the rotor is freely rotatable relative to the bushing.

The rotor 258 has upper index or cam elements 266 and lower index or cam elements 268. The upper index or cam elements 266 are engagable with either the upper index positions 252 or the lower index positions 254 (FIG. 11) depending upon the position to which the rotor 258 is rotated relative to the cup-shaped housing 228. The upper index elements 266 cooperate with the upper index positions 252 to limit upward movement of the switch action mechanism 156 and the force transmitting member 62. The upper index elements 266 cooperate with the lower index positions 254 to rotate the rotor 258 relative to the cup-shaped bushing 228 and to retain the switch action mechanism 156 and the force transmitting member 62 in a position corresponding to the actuated condition of the switch mechanism 152.

Figure 11:
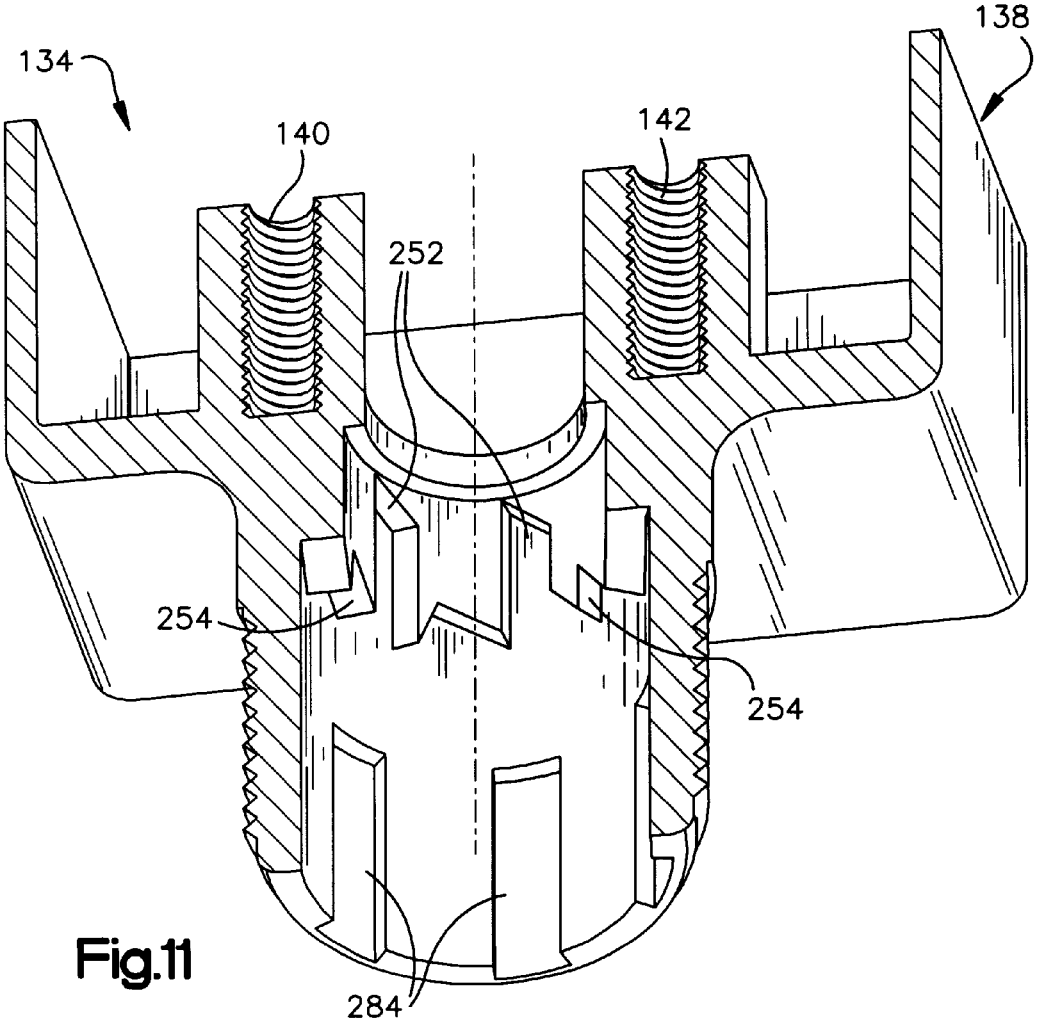
FIG. 11 is a fragmentary pictorial illustration of a portion of the housing of the switch module of FIG. 5 and illustrating the manner in which index positions and guide surfaces for the switch action mechanism are formed in the housing.

When the switch units 164–170 (FIG. 6) are in the unactuated condition, the actuator link 174 is in a raised (as viewed in FIGS. 2 and 7) position. At this time, the upper index elements 266 (FIG. 8) on the rotor 258 are disposed in engagement with the upper index positions 252 (FIG. 11). Upon actuation of the push button 52 by manually depressing the push button, the rotor 258 is moved axially downward (as viewed in FIGS. 8 and 9) relative to the housing 134 (FIG. 11).

As this occurs, the upper index elements 266 (FIG. 8) are moved downward to a location beneath the lower index positions 254 (FIG. 11). The rotor 258 is then rotated through a relatively short arcuate distance relative to the cup-shaped bushing 228. This moves the upper index elements 266 into partial alignment with the lower index positions 254.

When the push button 52 is manually released, the force transmitting member 62 and the rotor 258 (FIG. 8) are moved upward. The upper index elements 266 engage the lower index positions 254 (FIG. 11) and further rotate the rotor 258 relative to the housing 134. This rotation of the rotor 258 fully aligns the upper index elements 266 with the lower index positions 254. As this occurs, the upper index elements 266 engage the lower index positions 254 to hold the actuator link 174 in a lowered position in which the switch units 164–170 are in the actuated condition.

The next time the push button 52 is manually depressed, the upper index elements 266 (FIGS. 8 and 9) on the rotor 258 move downward out of engagement with the lower index positions 254 (FIG. 11) on the main section 138 of the housing 134. As this occurs, the rotor 258 is rotated through a short arcuate distance relative to the cup-shaped bushing 228 to move the upper index elements 266 into alignment with the upper index positions 252 in the main section 138 of the housing 134. When the push button is subsequently released, the rotor 258 moves upward in the housing 134 until the upper index elements 266 engage the upper index positions 252. When this occurs, upward movement of the rotor 258 and the force transmitting member 62 is blocked. At this time, the actuator link 174 is in a raised position and the switch units 164–170 are in the unactuated condition.

To provide for rotation of the rotor 258 relative to the housing 134 as the push button 52 is depressed, an annular index or cam member 272 (FIGS. 2 and 7) is disposed in the housing 134. The index or cam member 272 is continuously urged in an upward direction by a helical index spring 276. Cam elements 278 on the index member 272 are engagable with the lower index elements 268 (FIGS. 8 and 9) on the rotor 258.

The index member 272 (FIG. 7) is provided with lugs 282 which engage linear grooves 284 formed in the housing 134 (FIG. 11). The grooves 284 cooperate with the index member 272 to hold the index member against rotation relative to the housing 134. However, the grooves 284 allow the index member 272 to move in a vertical direction (as viewed in FIG. 2) relative to the housing 134. The index spring 276 is effective to urge the index member 272 upward (as viewed in FIG. 2) toward the upper end portions of the grooves 284.

It is contemplated that the switch action mechanism 156 may be changed from the previously described alternate action-type switch mechanism to a momentary-type switch mechanism. To change the switch action mechanism 156, the cap 144 (FIG. 2) is removed from the main section 138 of the housing 134. When the cap is removed, the index spring 276 and the index member 272 can be removed from the housing. At the same time, the main spring 58 can be removed from the housing.

The releasable connector 220 (FIG. 9) is then operated to a disengaged condition in which it is ineffective to interconnect the cup-shaped bushing 228 and the force transmitting member 62. To operate the releasable connector 220 to its disengaged condition, upward force is applied to the grooves 242 (FIG. 3) in the push button 52 when the push button is in its unactuated position (FIG. 2). This upward force presses the cam surface 246 (FIG. 9) against the resilient member 222. The resilient member 222 is radially expanded to release the force transmitting member 62.

When the releasable connector 220 has been operated to the disengaged condition, the cup-shaped bushing 228 and rotor 258 can be moved together out of the housing 134 (FIG. 2). A cup-shaped bushing, having the same general construction as the cup-shaped bushing 228 but without the rotor 258 is then moved into the housing. The new cup-shaped bushing does not have a rotor 258. Therefore, the new cup-shaped bushing is ineffective to engage either the upper index positions 252 (FIG. 11) or the lower index positions 254 in the housing 134.

The switch module 44 is then reassembled with the new cup-shaped bushing and without the rotor 258. When the push button 52 is subsequently depressed, the switch units 164–170 are operated to the actuated condition. When the push button 52 is released, the main spring 58 is effective to move the actuator link 174 (FIG. 8) upward to operate the switch units 164–170 to the unactuated condition. By providing the housing 134 with the cap or closure member 144, the switch action mechanism 156 can be readily changed between an alternate action-type mechanism and a momentary action-type mechanism.

It is contemplated that the switch action mechanism 156 can be changed between an alternate action-type mechanism and a momentary action-type mechanism in a different manner if desired. For example, the upper and lower index positions 252 and 254 could be formed on a tubular sleeve which is inserted into a smooth bore in the housing 134. If this is done, the switch action mechanism 156 could be converted from an alternate action mechanism to a momentary action mechanism by merely removing the sleeve.

Operation

The control apparatus 22 is initially in the unactuated condition of FIG. 12. At this time, the switch units 164–170 (FIG. 6) are in the unactuated condition. When the switch units 164–170 are in the unactuated condition, the movable switch contact 194 in the switch unit 164 (FIG. 12) is disposed in engagement with the stationary switch contact 192. This completes an electrical circuit between the terminals 120 and 122 on the switch module 44. Although only the switch unit 164 is illustrated in FIG. 12, it should be understood that the other switch units 166–170 have the same construction as the switch unit 164 and are in the same condition as the switch unit 164.

When the push button 52 is depressed for the first time, the force transmitting member 62 is moved downward (as viewed in FIG. 12). As the push button 52 is moved downward, the actuator link 174 is moved downward by force transmitted from the push button 52 through the force transmitting member 62 to the actuator link 174. The downward movement of the actuator link 174 from the unactuated position illustrated in FIG. 12 toward the actuated position illustrated in FIG. 13 simultaneously moves the pivot levers 206 in the switch units 164–170 downward to effect operation of the switch units from the unactuated condition to the actuated condition.

As the switch units 164–170 are operated from the unactuated condition to the actuated condition, the movable contact 194 in each of the switch units moves from a position in engagement with the stationary upper contact 192 into engagement with the stationary lower contact 190. When the movable switch contact 194 is in engagement with the stationary lower switch contact 190 (FIG. 13), a circuit is completed between the terminals 120 and 124 and the circuit is interrupted between the terminals 122 and 120. Operation of the switch units 164–170 to the actuated condition also results in circuitry connected with the light sources 82 and 84 changing the condition of the light sources. This results in a change in the illumination of the push button 52.

When the control apparatus 22 is to be operated from the unactuated condition (FIG. 12) to the actuated condition (FIG. 13), the force transmitting member 62 is moved downward under the influence of force which is manually applied to the push button 52. The rotor 258 in the switch action mechanism 156 is moved downward by force transmitted from the force transmitting member 62 through the releasable connector 220 (FIG. 9) to the cup-shaped bushing 228. As the rotor 258 moves downward, the upper index elements 266 on the rotor 258 move out of engagement with the upper index positions 252 (FIG. 11) on the housing 134. As the force transmitting member 62 and cup-shaped bushing 228 continue to move downward, force applied against the main spring 58 by the mounting ring 260 compresses the main spring in the housing 134.

As the rotor 258 continues to move downward (as viewed in FIG. 12) with the force transmitting member 62, the lower index elements 268 (FIG. 8) on the rotor 258 move into engagement with the cam elements 278 (FIG. 7) on the index member 272. The index member 272 is held against rotation relative to the housing 134 by engagement of the lugs 282 with the grooves 284 (FIG. 11) formed in the housing 134. Therefore, force transmitted from the rotor 258 (FIG. 12) to the index member 272 is effective to move the index member 272 straight downward in the housing 134. As the lower index elements 268 on the rotor 258 move into engagement with the cam elements 278 on the index member 272, the rotor 258 is rotated relative to the housing 134. This rotation of the rotor 258 moves the upper index elements 266 on the rotor into partial alignment with the lower index positions 254 (FIG. 11) on the housing 134.

When the push button 52 is manually released, the main spring 58 applies force against the mounting ring 260 to move the cup-shaped bushing 228 and force transmitting member 62 upward relative to the housing 134. As this occurs, the upper index elements 266 on the rotor 258 move into engagement with the lower index positions 254 on the housing 134. The lower index positions 254 on the housing 134 apply a cam action or force against the upper index elements 266 on the rotor 258 to complete the rotation of the rotor 258 relative to the housing. As this occurs, the upward movement of both the rotor 258 and force transmitting member 62 is interrupted by engagement of the upper index elements 266 on the rotor 258 with the lower index positions 254 on the housing 134. This results in the switch units 164–170 being held in the actuated condition of FIG. 13. In addition, the force transmitting member 62 and push button 52 are held against further upward movement relative to the housing 134 under the influence of the main spring 58.

Although the force transmitting member 62 and push button 52 have moved upward from the fully depressed position of the push button, the extent of the upward movement is not sufficient to effect actuation of the switch units 164–170 from the actuated condition back to the unactuated condition. Therefore, the switch units 164–170 are held in the actuated condition (FIG. 13) by engagement of the upper index elements 266 on the rotor 258 with the lower index positions 254 on the housing 134. This blocks further upward movement of the push button 52 and the force transmitting member 62. Since the push button 52 is partially retracted, there is a clear tactile indication to an observer that the push button has not returned to its initial or unactuated condition.

When the switch units 164–170 are to be operated back to their unactuated or initial condition, the push button 52 is again depressed. As this occurs, the force transmitting member 62 and rotor 258 are moved downward toward the index member 272. The cam elements 278 on the index member 272 cooperate with the rotor 258 to further rotate the rotor 258 relative to the housing 134. As this occurs, the upper index elements 266 on the rotor 258 move out of alignment with the lower index positions 254 on the housing 134 toward a position of alignment with the upper index positions 252.

When the push button 52 is released, the main spring 58 moves the cup-shaped bushing 228 and rotor 258 upward. The force applied against the mounting ring 260 on the cup-shaped bushing 228 by the main spring 58 is transmitted through the releasable connector 220 to the force transmitting member 62. This force moves the rotor 258, cup-shaped bushing 228, force transmitting member, actuator link 174, and push button 52 upward.

As the rotor 258 begins to move upward, the upper index elements 266 on the rotor rotate the rotor relative to the housing 134. This rotation moves the upper index elements 266 into alignment with the upper index positions 252 in the housing 134. Therefore, the main spring 58 can move the upper index elements 266 on the rotor 258 upward toward the upper index positions 252. As this occurs, the force transmitting member 62 and actuator link 174 move upward to effect operation of the switch units 164–170 from the actuated condition of FIG. 13 back to the unactuated condition of FIG. 12. Upward movement of the index member 272 under the influence of the index spring 276 is limited by engagement of the lugs 282 with the upper ends of the grooves 284 in the housing 134.

When the switch module 44 is to be changed from an alternate action-type switch module to a momentary action-type switch module, the cap 144 is disconnected from the main section 138 of the housing 134. The index spring 276, index member 272, and main spring 58 are then easily removed from the housing 134.

The releasable connector 220 must then be operated to a disengaged condition to enable the cup-shaped bushing 228 to be removed from the housing 134. At this time, the push button 52 is in the unactuated position of FIGS. 2 and 12. To operate the releasable connector 220 to the disengaged condition, the grooves 242 on the push button 52 are engaged by a suitable tool or tools. The push button 52 is then pulled upward from its unactuated position, that is, in a direction away from the circuit board 26.

The cam surface 246 (FIG. 9) on the force transmitting member 62 then applies force to the resilient member 222. This force expands the resilient member 222 and enables the force transmitting member 62 to be pulled axially upward out of the cup-shaped bushing 228. As this occurs, the bushing 228 is disengaged from the force transmitting member 62. The bushing 228 is then free to drop out of the open housing 134 under the influence of gravity.

A second cup-shaped bushing having the same configuration as the cup-shaped bushing 228 without the rotor 258, is then moved into the housing 134 through the open end of the housing. The push button 52 is pressed downward as the second cup-shaped bushing 228 (devoid of a rotor 258) is moved into the housing. This causes the lower end portion 238 of the force transmitting member 62 to expand the resilient member 222. The second cup-shaped bushing 228 is then pushed upward along the force transmitting member 62 until the resilient member 222 snaps into the groove 224 in the force transmitting member. The second cup-shaped bushing, without a rotor 258, is then securely connected with the force transmitting member 62.

The main spring 58 and index member 272 are then reinserted into the housing 134. The index spring 276 is positioned in the housing 134 in engagement with the index member 272. The cap 144 is then reconnected with the main section 138 of the housing 134.

Since there is no rotor 258 connected with the second cup-shaped bushing 258, the second cup-shaped bushing is free to move past the lower index positions 254 whenever the push button 52 is depressed and released. Therefore, each time the push button 52 is depressed and released, the push button returns to the unactuated position. This results in the switch action mechanism 156 being of the momentary action-type.

When the switch module 44 is to be converted to an indicator-type module, the housing 134 is opened by removing the cap 144. The index spring 276, index member 272 and main spring 58 are then removed from the housing. The push button 52 is pulled upward by engaging the grooves 252 with a suitable tool. This results in the releasable connector 220 being operated to a disengaged condition.

The momentary action cup-shaped bushing 228 is then removed from the housing. An indicator-type cup-shaped bushing 228 is then substituted for the momentary action-type cup-shaped bushing 228. The indicator-type cup-shaped bushing 228 has a side wall 232 which is axially longer than the side walls on either the momentary action-type cup-shaped bushing or the alternate action-type cup-shaped bushing. The axial extent of the indicator-type cup-shaped bushing is sufficient to result in the circular bottom wall 230 of the indicator-type cup-shaped bushing being engaged by the cap 144 when the switch module 44 is reassembled.

To reassemble the switch module 44, the push button 52 is pressed downward and the indicator-type cup-shaped bushing 228 is connected with the force transmitting member 62 by a releasable connector 220. The main spring 58 and index member 72 are then moved into the housing in a coaxial relationship with the indicator-type cup-shaped bushing 228. The index spring 276 is then positioned in the housing around both the main spring 58 and the lower end portion of the indicator-type cup-shaped bushing 228. The cap 144 is then connected with the housing 134 to again close the housing. The axial extent of the indicator-type cup-shaped bushing 228 results in the bottom wall 230 of the indicator-type cup-shaped bushing engaging the cap 144 to block movement of the push button 52 relative to the circuit board 26.

The foregoing description has assumed that the control apparatus 22 is mounted on the circuit board 26. Although the control apparatus 22 may advantageously be mounted on the circuit board 26, the control apparatus 22 can also be mounted at locations which are spaced from the circuit board. It is believed that the control apparatus 22 will be used in environments which do not have a circuit board 26 and where convertibility of the switch action mechanism 58 is desired.

Conclusion

In view of the foregoing description, it is apparent that the present invention provides a new and improved control apparatus 22 which includes a manually engagable push button 52 disposed adjacent to a first side 30 of a circuit board 26. One or more switches 164, 166, 168 and 170 may be enclosed by a housing 134 disposed adjacent to a second side 32 of the circuit board. A force transmitting member 62 extends from the push button 52 through an opening 108 in the circuit board 26 into the housing 134. The force transmitting member 62 is movable under the influence of force applied to the push button 52 to effect operation of at least one switch in the housing 134. It is contemplated that one or more switches of any one of many known designs may be located in the housing 134.

A plurality of switches 164, 166, 168 and 170 are illustrated as being disposed in the housing in an array which extends around the force transmitting member 62. An actuator link 174 is illustrated as being connected with the force transmitting member 62 and the plurality of switches 164, 166, 168 and 170. However, a greater or lesser number of switches of any desired design could be connected with the force transmitting member 62. Upon actuation of the push button 52 and movement of the force transmitting member 62, the actuator link 174 is moved to effect operation of the switches 164–170 between an unactuated condition and an actuated condition.

A releasable connector 220 may be provided to connect the force transmitting member 62 with components disposed in the housing. The releasable connector 220 may be operated from an engaged condition to a disengaged condition by moving the push button 52 away from the circuit board 26.

If desired, the releasable connector 220 which connects the components in the housing with the force transmitting member 62, may be operated to a disengaged condition. The housing 134 and components therein may then be disconnected from the circuit board 26 and replaced by another housing containing the same or different components.

The housing 134 may be opened, while the housing is still connected with the circuit board 26, to enable operating characteristics of one or more switches enclosed by the housing 134 to be changed. For example, the operating characteristics of the switches 164, 166, 168 and 170 enclosed by the housing 134 may be changed between an alternate action switch and a momentary action switch. This change is effected while terminals 112, 114, 116, and 118 connected with the switches 164, 166, 168 and 170 remain connected to the circuit board 26.

What is claimed is:

1. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a switch connected with said circuit board and disposed adjacent to the second side of said circuit board, said switch being operable from an unactuated condition to an actuated condition upon movement of said push button in the second direction from the unactuated position to the actuated position, and a releasable connector which connects said push button with said switch, said releasable connector being operable from an engaged condition connecting said push button with said switch to a disengaged condition in which said releasable connector is ineffective to connect said push button with said switch in response to movement of said push button in the first direction from the unactuated position under the influence of force applied to said push button.

2. An apparatus as set forth in claim 1 wherein said releasable connector includes a resilient member and a cam surface which deflects said resilient member to effect operation of said releasable connector from the engaged condition to the disengaged condition as said push button is moved in the first direction from the unactuated position.

3. An apparatus as set forth in claim 1 further including a housing which is disposed adjacent to the second side of said circuit board and a biasing spring which is disposed in said housing, said biasing spring having a first end portion which applies force transmitted to said housing and a second end portion which applies force transmitted to said releasable connector to urge said push button in the first direction toward the unactuated position of said push button when said push button is in the actuated position.

4. An apparatus as set forth in claim 1 further including a housing which is disposed adjacent to the second side of said circuit board and which encloses said switch and said releasable connector, a force transmitting member which is connected with said push button and extends through said circuit board, and a retainer assembly which is connected with said force transmitting member by said releasable connector, said retainer assembly includes a retainer surface connected with said housing and a movable retainer member which is connected with said force transmitting member by said releasable connector, said movable retainer member being movable from a position spaced from said retainer surface to a position disposed in engagement with said retainer surface in response to manual actuation of said push button and movement of said force transmitting member in the second direction relative to said circuit board to effect operation of said switch from the unactuated condition to the actuated condition and subsequent movement of said force transmitting member in the first direction with said switch in the actuated condition, said movable retainer member being effective to retain said force transmitting member against movement in the first direction upon interruption of manual actuation of the push button with said switch in the actuated condition and with said retainer member disposed in engagement with said retainer surface.

5. An apparatus as set forth in claim 4 wherein said movable retainer member is rotatable relative to said force transmitting member, said retainer assembly includes a cam surface which is disposed in said housing and is effective to rotate said movable retainer member relative to said force transmitting member during movement of said push button in the second direction from the unactuated position to the actuated position.

6. An apparatus as set forth in claim 5 wherein said cam surface is movable in the second direction with said push button, force transmitting member, and retainer member during movement of said push button from the unactuated position to the actuated position.

7. An apparatus as set forth in claim 6 further including a spring disposed in said housing to urge said cam surface in the first direction, said cam surface being movable in the second direction against the influence of said spring under the influence of force transmitted from said push button through said force transmitting member, releasable connector, and movable retainer member to said cam surface.

8. An apparatus as set forth in claim 7 wherein said housing includes a first portion which is connected with said circuit board and a second portion which is movable relative to said first portion of said housing between a closed condition blocking access to an interior of said housing and an open condition providing access to the interior of said housing, said spring and cam surface being movable out of said housing through an opening formed by movement of said second portion of said housing to the open condition.

9. An apparatus as set forth in claim 1 further including a housing which is disposed adjacent to the second side of said circuit board and which encloses said switch and said releasable connector, and alternate action means disposed in said housing to retain said switch in the actuated condition upon manual movement of said push button from the unactuated position to the actuated position and subsequent manual release of the push button, at least a portion of said alternate action means being removable from said housing to convert said switch from an alternate action switch to a momentary action switch.

10. An apparatus as set forth in claim 1 further including a light source disposed adjacent to the first side of said circuit board and connected with said circuit board, said light source being energizable to illuminate said push button, and a light shroud connected with said circuit board and extending around said light source, said light shroud having a first end portion disposed adjacent to the first side of said circuit board and a second end portion which is disposed in a telescopic relationship with said push button, said push button being movable relative to said light source and to said light shroud during movement of said push button from the unactuated position to the actuated position.

11. An apparatus as set forth in claim 10 wherein said push button includes a surface which moves along a surface on said light shroud to guide movement of said push button between the actuated and unactuated positions.

12. An apparatus as set forth in claim 10 wherein said light shroud includes a surface which at least partially encloses a portion of said force transmitting member and is effective to guide movement of said force transmitting member relative to said circuit board during movement of said push button between the actuated and unactuated positions.

13. An apparatus as set forth in claim 10 further including a force transmitting member which is connected with said push button and extends through said circuit board, said force transmitting member being connected with said switch by said releasable connector, said light shroud includes a first section and a second section which at least partially define a slot, said push button includes a section which extends into said slot during movement of said push button between the actuated and unactuated positions.

14. An apparatus as set forth in claim 1 further including a force transmitting member which is connected with said push button and extends through said circuit board, said force transmitting member being connected with said switch by said releasable connector, said releasable connector includes a cup-shaped member having a side wall which extends between an end wall and a rim portion of said cup-shaped member and a resilient member connected with the rim portion of said cup-shaped member, said second end portion of said force transmitting member being at least partially disposed in said cup-shaped member, said force transmitting member being movable relative to said cup-shaped member in the first direction with said push button during movement of said push button in the first direction from the actuated position, said resilient member being deflected upon movement of said push button in the first direction from the unactuated position of said push button to effect operation of said releasable connector from the engaged condition to the disengaged condition.

15. A method comprising the steps of providing a circuit board having a push button disposed adjacent to a first side of the circuit board and a housing disposed adjacent to a second side of the circuit board and connected to the circuit board, manually moving the push button relative to the circuit board to actuate a switch enclosed by the housing, and converting the switch enclosed by the housing between an alternate action switch and a momentary action switch while the housing remains connected to the circuit board and while the switch remains in the housing.

16. A method as set forth in claim 15 wherein said step of converting the switch enclosed by the housing between an alternate action switch and a momentary action switch includes opening the housing and removing a member from the housing.

17. A method as set forth in claim 15 wherein said step of converting the switch enclosed by the housing between an alternate action switch and a momentary action switch includes opening the housing, removing a first member from the housing, and inserting a second member into the housing.

18. A method as set forth in claim 15 wherein said step of manually moving the push button relative to the housing includes transmitting force from the push button to a first member through a releasable connector which connects the first member with the push button and rotating the first member relative to the housing when the switch is operated as an alternate action switch, said step of converting the switch enclosed by the housing between an alternate action switch and a momentary action switch includes opening the housing, disconnecting the first member from the push button by operating the releasable connector to a disengaged condition, removing the first member from the housing, moving a second member into the housing, connecting the second member with the push button by operating a releasable connector to an engaged condition, and closing the housing, said method further include manually moving the push button relative to the circuit board to actuate the switch, transmitting force from the push button through the releasable connector to the second member after performing said step of closing the housing.

19. An apparatus comprising a circuit board having a first side which faces in a first direction and a second side which faces in a second direction, a manually engagable push button disposed adjacent to the first side of said circuit board, said push button being manually movable relative to said circuit board between an actuated position and an unactuated position, a switch connected with said circuit board and disposed adjacent to the second side of said circuit board, said switch being operable between an actuated condition and an unactuated condition, a force transmitting member extending through an opening in said circuit board, said force transmitting member having a first end portion connected with said push button and a second end portion connected with said switch, said force transmitting member being movable relative to said circuit board under the influence of force manually applied to said push button to effect operation of said switch from the unactuated condition to the actuated condition, a housing enclosing said switch and said second end portion of said force transmitting member, and a plurality of terminals connected with said switch and extending from said housing into a plurality of openings formed in said second side of said circuit board.

20. An apparatus as set forth in claim 19 further including first and second light sources disposed adjacent to the first side of said circuit board and connected with said circuit board, said first light source being energizable to illuminate a first portion of said push button, said second light source being energizable to illuminate a second portion of said push button, a first light shroud section connected with said circuit board and extending around said first light source to direct illumination from said first light source toward said first portion of said push button, a second light shroud section connected with said circuit board and extending around said second light source to direct illumination from said second light source toward said second portion of said push button, and a panel connected with said push button and extending between said first and second shroud sections, said panel being movable with said push button relative to said first and second light shroud sections.

21. An apparatus as set forth in claim 19 further including first and second light sources disposed adjacent to the first side of said circuit board and fixedly connected with said circuit board, said first light source being energizable to illuminate a first portion of said push button, said second light source being energizable to illuminate a second portion of said push button, a first light shroud section connected with said circuit board and extending around said first light source to direct illumination from said first light source toward said first portion of said push button, and a second light shroud section connected with said circuit board and extending around said second light source to direct illumination from said second light source toward said second portion of said push button, said force transmitting member extends from said push button between outer side surfaces of said first and second light shroud sections to the opening in said circuit board.

22. An apparatus as set forth in claim 19 further including an alternate action mechanism disposed in said housing to impart alternate action operating characteristics to said switch, and a releasable connector for securing at least a portion of said alternate action mechanism to said force transmitting member.

23. An apparatus as set forth in claim 22 further including an actuator connected with said force transmitting member to effect operation of said releasable connector from an engaged condition to a disengaged condition in response to movement of said push button in the first direction from the actuated position of said push button.

24. An apparatus as set forth in claim 19 wherein said switch includes movable and stationary contacts which are connected with said terminals.

25. An apparatus as set forth in claim 19 wherein said housing includes a first portion which is fixedly connected with said circuit board and a second portion which is releasably connected with said first portion of said housing and is movable relative to said first portion of said housing between a closed position blocking access to an interior of said housing and an open position providing access to the interior of said housing.

26. A method comprising the steps of providing a control apparatus having a housing and a push button which is movable relative to the housing to actuate a switch in the housing, moving a closure member from a closed position to an open position to clear an opening in the housing, converting the switch from a first type of action to a second type of action, and, thereafter, moving the closure member from the open position to the closed position.

27. A method as set forth in claim 26 wherein said step of converting the switch from a first type of action to a second type of action includes converting the switch between an alternate action-type switch and a momentary action-type switch.

28. A method as set forth in claim 26 wherein said step of converting the switch from a first type of action to a second type of action includes moving the push button from an unactuated position in a direction away from an actuated position of the push button and disconnecting the push button from a component of the control apparatus disposed in the housing.

29. A method as set forth in claim 28 wherein said step of converting the switch from a first type of action to a second type of action includes moving the component of the control apparatus from which the push button was disconnected from the housing through the opening cleared by moving the closure member from the open position to the closed position.

30. A method as set forth in claim 29 wherein said step of converting the switch from a first type of action to a second type of action includes moving a component into the housing through the opening cleared by moving the closure member from the closed position to the open position to replace the component which was previously disconnected from the push button and moved from the housing.

31. A method as set forth in claim 26 wherein the control apparatus is connected with a circuit board and said step of converting the switch from a first type of action to a second type of action includes moving the push button from an unactuated position in a direction away from the circuit board and disconnecting the push button from a component of the control apparatus disposed in the housing under the influence of force transmitted from the push button during movement of the push button in a direction away from the circuit board.

32. A method as set forth in claim 31 wherein said step of disconnecting the push button from a control apparatus disposed in the housing under the influence of force transmitted from the push button includes deflecting a resilient member under the influence of force transmitted from the push button.

33. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member extending through an opening in said circuit board, said force transmitting member having a first end portion connected with said push button and a second end portion connected with said movable switch contacts, said force transmitting member being movable relative to said circuit board under the influence of force manually applied to said push button to effect movement of said movable switch contacts relative to said stationary switch contacts, a biasing spring disposed adjacent to said second side of said circuit board and connected with said force transmitting member, said biasing spring being effective to urge said force transmitting member in the first direction relative to said circuit board, and a retainer assembly disposed adjacent to said second side of said circuit board and connected with said force transmitting member and said circuit board, said retainer assembly includes a retainer surface which is connected with said circuit board and a movable retainer member which is connected with said force transmitting member, said movable retainer member being movable from a position spaced from said retainer surface to a position disposed in engagement with said retainer surface in response to manual actuation of said push button and movement of said force transmitting member in the second direction relative to said circuit board to effect movement of said movable switch contacts from the unactuated condition to the actuated condition, said movable retainer member being effective to transmit force from said biasing spring to said retainer surface to retain said force transmitting member against movement in the first direction upon interruption of manual actuation of the push button with said movable switch contacts in the actuated condition and with said movable retainer member disposed in engagement with said retainer surface.

34. An apparatus as set forth in claim 33 wherein said movable retainer member is connected with said force transmitting member by a releasable connector, said releasable connector being operable between an engaged condition connecting said movable retainer member with said force transmitting member and a disengaged condition in which said releasable connector is ineffective to connect said movable retainer member with said force transmitting member, said releasable connector being operable from the engaged condition to the disengaged condition in response to movement of said push button and said force transmitting member in the first direction relative to said circuit board.

35. An apparatus as set forth in claim 33 further including a housing enclosing said stationary switch contacts and said movable switch contacts, said housing being disposed adjacent to said second side of said circuit board, a first plurality of terminals connected with said stationary switch contacts and extending from said housing into said circuit board, and a second plurality of terminals connected with said movable switch contacts and extending from said housing into said circuit board.

36. An apparatus as set forth in claim 33 further including a housing which encloses said stationary switch contacts and said movable switch contacts, said housing being disposed adjacent to said second side of said circuit board, said second end portion of said force transmitting member being disposed in said housing, said housing having a first portion which is connected with said circuit board and a second portion which is movable relative to said first portion of said housing between a closed condition blocking access to an interior of said housing and an open condition providing access to the interior of said housing.

37. An apparatus as set forth in claim 36 further including an index member disposed in said housing, said retainer member being movable relative to said housing by said index member upon manual movement of said push button from the unactuated position to the actuated position, at least one of said index and retainer members said being accessible from outside said housing when said second portion of said housing is in the open condition to enable at least said one of said index and retainer members to be removed from said housing.

38. An apparatus as set forth in claim 33 further including a plurality of light sources disposed adjacent to the first side of said circuit board and connected with said circuit board, and a light shroud connected with said circuit board and extending around said light sources, said light shroud having a first end portion disposed adjacent to the first side of said circuit board and a second end portion which is disposed in a telescopic relationship with and is at least partially enclosed by said push button, said push button being movable relative to said light sources and to said light shroud to increase the telescopic relationship between said push button and said light shroud during movement of said push button from the unactuated position to the actuated position.

39. An apparatus as set forth in claim 38 said push button includes a surface which moves along a surface on said light shroud to guide movement of said push button between the actuated and unactuated positions.

40. An apparatus as set forth in claim 38 wherein said light shroud includes a surface which at least partially encloses a portion of said force transmitting member and is effective to guide movement of said force transmitting member relative to said circuit board during movement of said push button between the actuated and unactuated positions.

41. An apparatus as set forth in claim 38 wherein said light sources are disposed in a plurality of arrays, said light shroud having a plurality of sections each of which extends around one of said arrays of light sources.

42. An apparatus as set forth in claim 33 further including a housing enclosing said stationary switch contacts and said movable switch contacts, a plurality of terminals extend from said housing, at least some of said terminals being connected with said stationary switch contacts.

43. An apparatus as set forth in claim 33 further including a housing which is disposed adjacent to the second side of said circuit board and encloses said stationary switch contacts and said movable switch contacts, an actuator member disposed in said housing and movable relative to said housing to move said movable switch contacts relative to said stationary switch contacts, and a releasable connector assembly which connects said actuator member with said force transmitting member, said push button being movable in the first direction from the unactuated position of said push button to move said force transmitting member to operate said releasable connector assembly from an engaged condition to a disengaged condition, said releasable connector assembly being effective to transmit force to retain said second end portion of said force transmitting member in said housing when said releasable connector assembly is in the engaged condition, said releasable connector assembly being ineffective to retain said second end portion of said force transmitting member in said housing when said releasable connector assembly is in the disengaged condition.

44. An apparatus as set forth in claim 43 wherein said releasable connector assembly includes a resilient member which is engagable with said force transmitting member to enable force to be transmitted from said force transmitting member through said resilient member when said releasable connector assembly is in the engaged condition, said force transmitting member having a surface which applies force to said resilient member to effect deflection of said resilient member under the influence of force transmitted from said push button to said force transmitting member during movement of said push button in the first direction from the actuated position of said push button to effect operation of said releasable connector assembly from the engaged condition to the disengaged condition.

45. An apparatus as set forth in claim 33 wherein said plurality of stationary switch contacts and said plurality of movable switch contacts are disposed in a plurality of groups of switch contacts which are arranged in an array which extends around said force transmitting member, each of said groups of switch contacts includes first and second stationary switch contacts, a movable switch contact, an actuator lever, and an actuator lever spring, said actuator lever having first and second end portions, said movable switch contact being connected with the first end portion of said actuator lever, said actuator lever being movable between a first position in which said movable switch contact is in engagement with said first stationary contact and a second position in which said movable switch contact is in engagement with said second stationary switch contact, said actuator lever spring being effective to move said actuator lever between the first and second positions in response to movement of said second end portion of said actuator lever relative to said stationary switch contacts, and an actuator link connected with said force transmitting member and the second end portion of said actuator lever in each of said groups of switch contacts, said actuator link being movable in the first and second directions with said force transmitting member to effect movement of said actuator lever in each of said groups of switch contacts.

46. An apparatus as set forth in claim 33 wherein said plurality of stationary contacts and said plurality of movable switch contacts are disposed in a plurality of groups of switch contacts which are arranged in an array which extends around said force transmitting member, said apparatus further including an actuator link connected with said force transmitting member, said actuator link being connected with said movable switch contacts in each of said groups of switch contacts.

47. An apparatus as set forth in claim 46 wherein said actuator link defines an opening through which said force transmitting member extends.

48. An apparatus as set forth in claim 46 wherein said actuator link is movable in the second direction under the influence of force transmitted from said push button through said force transmitting member to said actuator link to effect movement of said movable switch contact in each of said groups of switch contacts relative to said stationary switch contacts in each of said groups of switch contacts.

49. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member extending through an opening in said circuit board, said force transmitting member having a first end portion connected with said push button and a second end portion connected with said movable switch contacts, said force transmitting member being movable relative to said circuit board under the influence of force manually applied to said push button to effect movement of said movable switch contacts relative to said stationary switch contacts, a housing disposed adjacent to the second side of said circuit board and encloses said stationary switch contacts and said movable switch contacts, an actuator member disposed in said housing and movable relative to said housing to move said movable switch contacts relative to said stationary switch contacts, and a releasable connector assembly which connects said actuator member with said force transmitting member, said push button being movable in the first direction from the unactuated position of said push button to move said force transmitting member to operate said releasable connector assembly from an engaged condition to a disengaged condition, said releasable connector assembly being effective to transmit force to retain said second end portion of said force transmitting member in said housing when said releasable connector assembly is in the engaged condition, said releasable connector assembly being ineffective to retain said second end portion of said force transmitting member in said housing when said releasable connector assembly is in the disengaged condition, said releasable connector assembly includes a resilient ring which is engagable with a groove in said force transmitting member and an enclosing member which extends at least partially around said resilient ring to enable force to be transmitted from said force transmitting member through said resilient ring and said enclosing member to said housing when said releasable connector assembly is in the engaged condition, said force transmitting member having a cam surface which applies force to said resilient ring to effect expansion of said resilient ring under the influence of force transmitted from said push button to said force transmitting member during movement of said push button in the first direction from the actuated position of said push button to effect operation of said releasable connector assembly from the engaged condition to the disengaged condition.

50. An apparatus as set forth in claim 49 wherein said housing has a first portion which is connected with said circuit board and a second portion which is movable relative to said first portion of said housing between a closed condition blocking access to an interior of said housing and an open condition providing access to the interior of said housing.

51. An apparatus as set forth in claim 50 further including alternate action means disposed in said housing for retaining said movable switch contacts in the actuated condition upon manual movement of said push button from the unactuated position to the actuated position and subsequent manual release of said push button, said alternate action means being accessible from outside said housing when said second portion of said housing is in the open condition to enable at least a portion of said alternate action means to be removed from said housing to render said alternate action means ineffective to retain said movable switch contacts in the actuated condition.

52. An apparatus as set forth in claim 49 further including a plurality of light sources disposed adjacent to the first side of said circuit board and connected with said circuit board, and a light shroud connected with said circuit board and extending around said light sources, said light shroud having a first end portion disposed adjacent to the first side of said circuit board and a second end portion which is disposed in a telescopic relationship with and is at least partially enclosed by said push button, said push button being movable relative to said light sources and to said light shroud to increase the telescopic relationship between said push button and said light shroud during movement of said push button from the unactuated position to the actuated position.

53. An apparatus as set forth in claim 52 said push button includes a surface which moves along a surface on said light shroud to guide movement of said push button between the actuated and unactuated positions.

54. An apparatus as set forth in claim 52 wherein said light shroud includes a surface which at least partially encloses a portion of said force transmitting member and is effective to guide movement of said force transmitting member relative to said circuit board during movement of said push button between the actuated and unactuated positions.

55. An apparatus as set forth in claim 52 wherein said light sources are disposed in a plurality of arrays, said light shroud having a plurality of sections each of which extends around one of said arrays of light sources.

56. An apparatus as set forth in claim 49 wherein said plurality of stationary switch contacts and said plurality of movable switch contacts are disposed in a plurality of groups of switch contacts which are arranged in an array which extends around said force transmitting member, each of said groups of switch contacts includes first and second stationary switch contacts, a movable switch contact, an actuator lever, and an actuator lever spring, said actuator lever having first and second end portions, said movable switch contact being connected with the first end portion of said actuator lever, said actuator lever being movable between a first position in which said movable switch contact is in engagement with said first stationary contact and a second position in which said movable switch contact is in engagement with said second stationary switch contact, said actuator lever spring being effective to move said actuator lever between the first and second positions in response to movement of said second end portion of said actuator lever relative to said stationary switch contacts, and an actuator link connected with said force transmitting member and the second end portion of said actuator lever in each of said groups of switch contacts, said actuator link being movable in the first and second directions with said force transmitting member to effect movement of said actuator lever in each of said groups of switch contacts.

57. An apparatus as set forth in claim 49 wherein said plurality of stationary contacts and said plurality of movable switch contacts are disposed in a plurality of groups of switch contacts which are arranged in an array which extends around said force transmitting member, said actuator member being connected with said movable switch contacts in each of said groups of switch contacts.

58. An apparatus as set forth in claim 57 wherein said actuator member defines an opening through which said force transmitting member extends.

59. An apparatus as set forth in claim 57 wherein said actuator member is movable in the second direction under the influence of force transmitted from said push button through said force transmitting member to said actuator member to effect movement of said movable switch contact in each of said groups of switch contacts relative to said stationary switch contacts in each of said groups of switch contacts.

60. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member having a first end portion connected with said push button and a second end portion connected with said movable switch contacts, said force transmitting member being movable relative to said circuit board under the influence of force manually applied to said push button to effect movement of said movable switch contacts relative to said stationary switch contacts, a housing which encloses said stationary switch contacts and said movable switch contacts, said housing being disposed adjacent to said second side of said circuit board, said second end portion of said force transmitting member being disposed in said housing, said housing having a first portion which is connected with said circuit board and a second portion which is movable relative to said first portion of said housing between a closed condition blocking access to an interior of said housing and an open condition providing access to the interior of said housing, and alternate action means disposed in said housing for retaining said movable switch contacts in the actuated condition upon manual movement of said push button from the unactuated position to the actuated position and subsequent manual release of said push button, said alternate action means being accessible from outside said housing when said second portion of said housing is in the open condition to enable at least a portion of said alternate action means to be removed from said housing to render said alternate action means ineffective to retain said movable switch contacts in the actuated condition.

61. An apparatus as set forth in claim 60 further including a plurality of light sources disposed adjacent to the first side of said circuit board and connected with said circuit board, and a light shroud connected with said circuit board and extending around said light sources, said light shroud having a first end portion disposed adjacent to the first side of said circuit board and a second end portion which is at least partially enclosed by said push button, said push button being movable relative to said light sources and to said light shroud during movement of said push button from the unactuated position to the actuated position.

62. An apparatus as set forth in claim 61 said push button includes a surface which moves along a surface on said light shroud to guide movement of said push button between the actuated and unactuated positions.

63. An apparatus as set forth in claim 61 wherein said light shroud includes a surface which at least partially encloses a portion of said force transmitting member and is effective to guide movement of said force transmitting member relative to said circuit board during movement of said push button between the actuated and unactuated positions.

64. An apparatus as set forth in claim 61 wherein said light sources are disposed in a plurality of arrays, said light shroud having a plurality of sections each of which extends around one of said arrays of light sources.

65. An apparatus as set forth in claim 61 further including an actuator member disposed in said housing and movable relative to said housing to move said movable switch contacts relative to said stationary switch contacts, and a releasable connector assembly which connects said actuator member with said force transmitting member, said push button being movable in the first direction from the unactuated position of said push button to move said force transmitting member to operate said releasable connector assembly from an engaged condition to a disengaged condition, said releasable connector assembly being effective to transmit force to retain said second end portion of said force transmitting member in said housing when said releasable connector assembly is in the engaged condition, said releasable connector assembly being ineffective to retain said second end portion of said force transmitting member in said housing when said releasable connector assembly is in the disengaged condition.

66. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member having a first end portion connected with said push button and a second end portion connected with said movable switch contacts, said force transmitting member being movable relative to said circuit board under the influence of force manually applied to said push button to effect movement of said movable switch contacts relative to said stationary switch contacts, a plurality of light sources disposed adjacent to the first side of said circuit board and connected with said circuit board, and a light shroud connected with said circuit board and extending around said light sources, said light shroud having a first end portion disposed adjacent to the first side of said circuit board and a second end portion which is disposed in a telescopic relationship with and is at least partially enclosed by said push button, said push button being movable relative to said light sources and to said light shroud to increase the telescopic relationship between said push button and said light shroud during movement of said push button from the unactuated position to the actuated position.

67. An apparatus as set forth in claim 66 said push button includes a surface which moves along a surface on said light shroud to guide movement of said push button between the actuated and unactuated positions.

68. An apparatus as set forth in claim 66 wherein said light shroud includes a surface which at least partially encloses a portion of said force transmitting member and is effective to guide movement of said force transmitting member relative to said circuit board during movement of said push button between the actuated and unactuated positions.

69. An apparatus as set forth in claim 66 wherein said light sources are disposed in a plurality of arrays, said light shroud having a plurality of sections each of which extends around one of said arrays of light sources.

70. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member having a first end portion connected with said push button and a second end portion connected with said movable switch contacts, said force transmitting member being movable relative to said circuit board under the influence of force manually applied to said push button to effect movement of said movable switch contacts relative to said stationary switch contacts, an actuator member connected with said movable switch contacts, and a releasable connector assembly which connects said actuator member with said force transmitting member, said push button being movable in the first direction from the unactuated position of said push button to move said force transmitting member and operate said releasable connector assembly from an engaged condition to a disengaged condition, said releasable connector assembly being effective to connect said actuator member with said force transmitting member when said releasable connector assembly is in the engaged condition, said releasable connector assembly being ineffective to connect said actuator member with said force transmitting member when said releasable connector assembly is in the disengaged condition.

71. An apparatus as set forth in claim 70 wherein said releasable connector assembly includes a resilient member which is engagable with a groove in said force transmitting member to enable force to be transmitted from said force transmitting member through said resilient member when said releasable connector assembly is in the engaged condition, said force transmitting member having a cam surface which applies force to said resilient member to deflect said resilient member under the influence of force transmitted from said push button to said force transmitting member during movement of said push button in the first direction from the actuated position of said push button to effect operation of said releasable connector assembly from the engaged condition to the disengaged condition.

72. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member having a first end portion connected with said push button and a second end portion, and an actuator link connected with said second end portion of said force transmitting member and with said movable switch contacts, said force transmitting member being movable relative to said circuit board under the influence of force manually applied to said push button to effect movement of said actuator link and said movable switch contacts relative to said stationary switch contacts, said plurality of stationary switch contacts and said plurality of movable switch contacts are disposed in a plurality of groups of switch contacts which are arranged in an array which extends around said force transmitting member, each of said groups of switch contacts includes first and second stationary switch contacts, a movable switch contact, and an actuator lever, said actuator lever having first and second end portions, said movable switch contact being connected with the first end portion of said actuator lever, said second end portion of said actuator lever being connected with said actuator link, said second end portion of said actuator lever being movable with said actuator link and said force transmitting member between a first position in which said movable switch contact is in engagement with said first stationary contact and a second position in which said movable switch contact is in engagement with said second stationary switch contact.

73. An apparatus comprising a circuit board having a first side which faces in a first direction and a second side which faces in a second direction, a manually engagable push button disposed adjacent to the first side of said circuit board, said push button being manually movable in the second direction relative to said circuit board from an unactuated position to an actuated position, a plurality of stationary switch contacts connected with said circuit board and disposed adjacent to the second side of said circuit board, a plurality of movable switch contacts disposed adjacent to the second side of said circuit board, said movable switch contacts being engagable with said stationary switch contacts, each of said movable switch contacts being movable relative to said circuit board between an actuated condition and an unactuated condition, a force transmitting member extending through an opening in said circuit board, said force transmitting member having a first end portion connected with said push button, an intermediate portion extending through the opening in the circuit board, and a second end portion, said intermediate portion of said force transmitting member being disposed between said first and second end portions of said force transmitting member, and an actuator link connected with said second end portion of said force transmitting member and connected with said movable switch contacts, said force transmitting member being movable relative to said circuit board under the influence of force manually applied to said push button to effect movement of said actuator link and said movable switch contacts relative to said stationary switch contacts.

74. An apparatus as set forth in claim 73 wherein said plurality of stationary switch contacts and said plurality of movable switch contacts are disposed in a plurality of groups of switch contacts which are arranged in an array which extends around said second end portion of said force transmitting member, each of said groups of switch contacts includes first and second stationary switch contacts, a movable switch contact, and an actuator lever, said actuator lever having first and second end portions, said movable switch contact being connected with the first end portion of said actuator lever, said second end portion of said actuator lever being connected with said actuator link, said actuator lever being movable between a first position in which said movable switch contact is in engagement with said first stationary contact and a second position in which said movable switch contact is in engagement with said second stationary switch contact.

75. An apparatus as set forth in claim 73 wherein said actuator link is connected with said force transmitting member by a releasable connector, said releasable connector being operable between an engaged condition connecting said actuator link with said force transmitting member and a disengaged condition in which said releasable connector is ineffective to connect said actuator link with said force transmitting member, said releasable connector being operable from the engaged condition to the disengaged condition in response to movement of said push button and said force transmitting member in the first direction relative to said circuit board.

76. An apparatus as set forth in claim 73 further including a housing enclosing said stationary switch contacts and said movable switch contacts, said housing being disposed adjacent to said second side of said circuit board, a first plurality of terminals connected with said stationary switch contacts and extending from said housing into first openings in said circuit board, and a second plurality of terminals connected with said movable switch contacts and extending from said housing into second openings in said circuit board.

77. An apparatus as set forth in claim 73 further including a housing which encloses said stationary switch contacts and said movable switch contacts, said housing being disposed adjacent to said second side of said circuit board, said second end portion of said force transmitting member being disposed in said housing, said housing having a first portion which is connected with said circuit board and a second portion which is movable relative to said first portion of said housing between a closed condition blocking access to an interior of said housing and an open condition providing access to the interior of said housing.

78. An apparatus as set forth in claim 77 further including alternate action means disposed in said housing for retaining said movable switch contacts in the actuated condition upon manual movement of said push button from the unactuated position to the actuated position and subsequent manual release of said push button, said alternate action means being accessible from outside said housing when said second portion of said housing is in the open condition to enable at least a portion of said alternate action means to be removed from said housing to render said alternate action means ineffective to retain said movable switch contacts in the actuated condition.

79. An apparatus comprising a circuit board having a first side which faces in a first direction and a second side which faces in a second direction, a manually engagable push button disposed adjacent to the first side of said circuit board, said push button being manually movable relative to said circuit board between an actuated position and an unactuated position, a force transmitting member having a first end portion disposed adjacent to the first side of said circuit board and a second end portion disposed adjacent to the second side of said circuit board, said first end portion of said force transmitting member being connected with said push button, a plurality of switches arranged in an array which extends around said force transmitting member, each of said switches includes a stationary component and a movable component, an actuator link connected with said force transmitting member and with said movable component of each of said switches, said actuator link being movable in the second direction relative to said circuit board under the influence of force transmitted from said push button through said force transmitting member to said actuator link to move the movable components of each of said switches of said plurality of switches upon movement of said push button from the unactuated position to the actuated position, and a releasable connector assembly connected with said second end portion of said force transmitting member, said releasable connector assembly being operable between an engaged condition in which said releasable connector assembly prevents separation of said second end portion of said force transmitting member from said actuator link and a disengaged condition in which said second end portion of said force transmitting member is separable from said actuator link, said releasable connector assembly being operable from the engaged condition to the disengaged condition in response to movement of said push button and said force transmitting member.

80. An apparatus as set forth in claim 79 wherein said releasable connector assembly includes a resilient member which is engagable with a recess in said force transmitting member, said force transmitting member having a cam surface which applies force to said resilient member to deflect said resilient member under the influence of force transmitted from said push button to said force transmitting member during movement of said push button in the first direction.

81. An apparatus as set forth in claim 80 further including a housing which is disposed adjacent to the second side of said circuit board, an enclosing member which extends at least partially around said resilient member, and a biasing spring which is disposed in said housing, said biasing spring has a first end portion which is disposed in engagement with said housing and a second end portion which is disposed in engagement with said enclosing member, said biasing spring being effective to apply force against said enclosing member to urge said force transmitting member in the first direction.

82. An apparatus comprising a circuit board having a first side which faces in a first direction and a second side which faces in a second direction, a manually engagable push button disposed adjacent to the first side of said circuit board, said push button being manually movable relative to said circuit board between an actuated position and an unactuated position, a switch connected with said circuit board and disposed adjacent to the second side of said circuit board, said switch being operable between an actuated condition and an unactuated condition, a force transmitting member having a first end portion connected with said push button and a second end portion connected with said switch, said force transmitting member being movable relative to said circuit board under the influence of force manually applied to said push button to effect operation of said switch from the unactuated condition to the actuated condition, first and second light sources disposed adjacent to the first side of said circuit board and fixedly connected with said circuit board, said first light source being energizable to illuminate a first portion of said push button, said second light source being energizable to illuminate a second portion of said push button, a first light shroud section connected with said circuit board and extending around said first light source to direct illumination from said first light source toward said first portion of said push button, and a second light shroud section connected with said circuit board and extending around said second light source to direct illumination from said second light source toward said second portion of said push button, said force transmitting member extends from said push button between outer side surfaces of said first and second light shroud sections.

83. An apparatus as set forth in claim 80 said push button includes surfaces which move along surfaces on said first and second light shroud sections to guide movement of said push button between the actuated and unactuated positions.

84. An apparatus as set forth in claim 80 wherein said first and second light shroud sections include surfaces which at least partially enclose a portion of said force transmitting member and are effective to guide movement of said force transmitting member relative to said circuit board during movement of said push button between the actuated and unactuated positions.

* * * * *